US010667550B2

(12) United States Patent
Ito et al.

(10) Patent No.: US 10,667,550 B2
(45) Date of Patent: Jun. 2, 2020

(54) FILTER FOR CIGARETTE PRODUCT AND CIGARETTE PRODUCT

(71) Applicant: JAPAN TOBACCO INC., Tokyo (JP)

(72) Inventors: Kenji Ito, Tokyo (JP); Yu Ninomiya, Tokyo (JP); Tomiharu Nagata, Tokyo (JP); Hiroyuki Torai, Tokyo (JP); Sadao Ogi, Tokyo (JP); Kazumasa Arae, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 79 days.

(21) Appl. No.: 15/702,410

(22) Filed: Sep. 12, 2017

(65) Prior Publication Data

US 2018/0000152 A1 Jan. 4, 2018

Related U.S. Application Data

(63) Continuation of application No. PCT/JP2015/057432, filed on Mar. 13, 2015.

(51) Int. Cl.
*A24D 3/04* (2006.01)

(52) U.S. Cl.
CPC ..... *A24D 3/041* (2013.01); *A24D 3/04* (2013.01); *A24D 3/045* (2013.01)

(58) Field of Classification Search
None
See application file for complete search history.

(56) References Cited

U.S. PATENT DOCUMENTS 4,273,141 A * 6/1981 Van Tilburg ..... A24D 3/043 131/336
4,649,942 A 3/1987 Horsewell et al.
5,178,166 A 1/1993 Newsome et al.
(Continued)

FOREIGN PATENT DOCUMENTS

CN 103110191 A 5/2013
EP 0 260 789 A1 3/1988
(Continued)

OTHER PUBLICATIONS

Japenese Office Action, dated Jan. 9, 2018, for Japanese Application No. 2017-505762.
(Continued)

*Primary Examiner* — Michael J Felton
*Assistant Examiner* — Katherine A Will
(74) *Attorney, Agent, or Firm* — Birch, Stewart, Kolasch & Birch, LLP

(57) ABSTRACT

The filter for cigarette product includes a mouthpiece end side-filter material and a front stage-filter material. The mouthpiece end side-filter material has a low air flow-resistance unit that is arranged in a part of a cross section from a front end surface to a rear end surface and having a relatively low air flow-resistance, and a high air flow-resistance unit that is arranged in the remainder of the cross section from the front end surface to the rear end surface and having a higher air flow-resistance than the low air flow-resistance unit. At least on the rear end surface of the mouthpiece end side-filter material, the low air flow-resistance unit is arranged only in one semicircular area, of two parts into which the cross section of the mouthpiece end side-filter material is divided.

8 Claims, 21 Drawing Sheets

(56) References Cited

U.S. PATENT DOCUMENTS

| | | | |
|---|---|---|---|
| 2004/0261807 | A1 | 12/2004 | Dube et al. |
| 2006/0272663 | A1 | 12/2006 | Dube et al. |
| 2011/0023896 | A1 | 2/2011 | Dube et al. |
| 2011/0186063 | A1 | 8/2011 | Fiebelkorn |
| 2011/0232658 | A1 | 9/2011 | Dube et al. |
| 2011/0232663 | A1 | 9/2011 | Kadiric et al. |
| 2014/0069447 | A1 | 3/2014 | Bailey et al. |
| 2014/0096785 | A1 | 4/2014 | Bailey et al. |
| 2014/0166031 | A1 | 6/2014 | Bailey et al. |

FOREIGN PATENT DOCUMENTS

| | | | |
|---|---|---|---|
| EP | 2368448 | A1 | 9/2011 |
| JP | 61-88868 | A | 5/1986 |
| JP | 5-23158 | A | 2/1993 |
| JP | 2007-520204 | A | 7/2007 |
| JP | 2010-11841 | A | 1/2010 |
| JP | 2014-513539 | A | 6/2014 |
| KR | 10-2014-0032437 | A | 3/2014 |
| WO | WO 2010/010397 | A1 | 1/2010 |

OTHER PUBLICATIONS

Extended European Search Report, dated Oct. 22, 2018, for European Application No. 15885344.0.

International Search Report for PCT/JP2015/057432 dated Jun. 2, 2015.

Russian Office Action and Search Report, dated Apr. 9, 2018, for Russian Application No. 2017132475, along with an English translation.

Korean Office Action, dated Feb. 28, 2019, for Korean Application No. 10-2017-7027045, with an English translation.

Chinese Office Action for Chinese Application No. 201580077767.7, dated Jul. 3, 2019, with an English translation.

International Preliminary Report on Patentability and English translation of the Written Opinion of the International Searching Authority (Forms PCT/IB/338, PCT/IB/373 and PCT/ISA/237) for International Application No. PCT/JP2015/057432, dated Sep. 28, 2017.

* cited by examiner

SMOKE UPWARD FLOWING POSTURE

SMOKE DOWNWARD FLOWING POSTURE

COMPARATIVE EXAMPLE
(CONTROL CIGARETTE)

FIG. 8
EXAMPLE
CAVITY UNIT INCLUDED TYPE
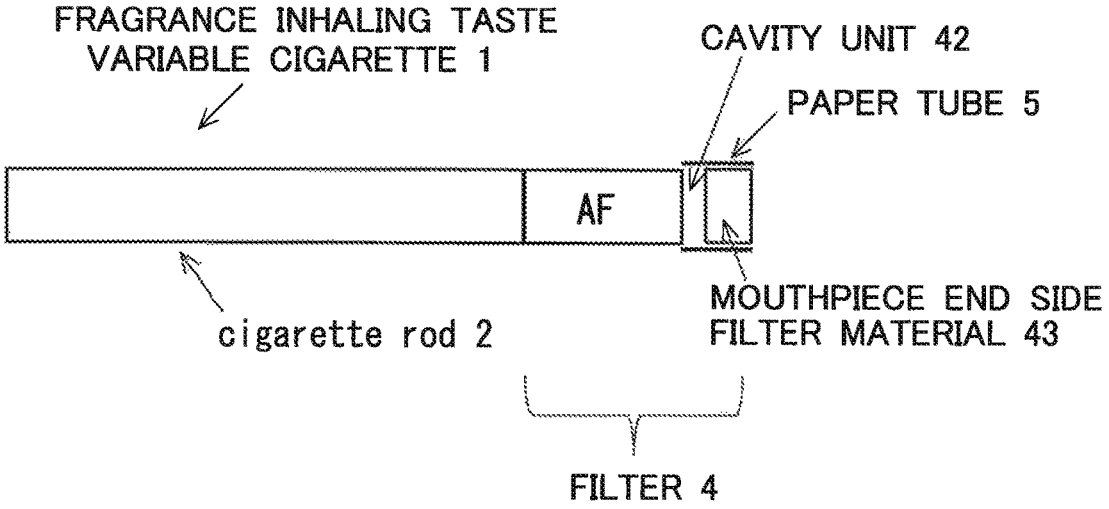
CAVITY UNIT NOT INCLUDED TYPE
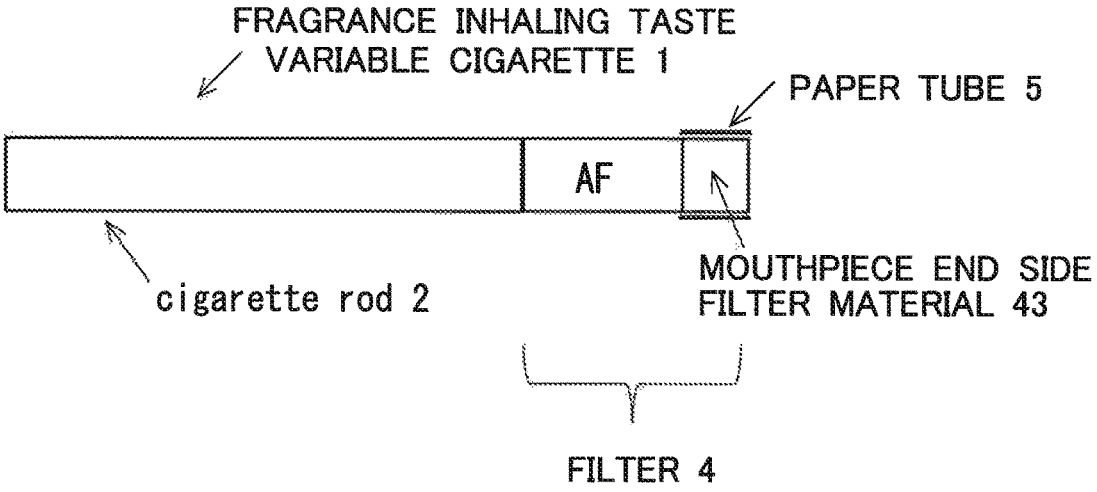

FIG. 9

| | TAR T(mg/cig) | STANDARD DEVIATION | NICOTINE N(mg/cig) | STANDARD DEVIATION | AIR FLOW RESISTANCE (mm/$H_2O$) | STANDARD DEVIATION |
|---|---|---|---|---|---|---|
| CONTROL | 9.05 | 0.41 | 0.69 | 0.03 | 150.0 | 6.9 |
| EXAMPLE 1(CAVITY INCLUDED TYPE) | 7.74 | 0.14 | 0.64 | 0.02 | 164.4 | 6.1 |
| EXAMPLE 2(CAVITY NOT INCLUDED TYPE | 8.54 | 0.17 | 0.67 | 0.01 | 153.8 | 7.6 |
| EXAMPLE 2(CAVITY INCLUDED TYPE) | 8.30 | 0.19 | 0.67 | 0.03 | 147.7 | 6.3 |
| EXAMPLE 3(CAVITY NOT INCLUDED TYPE | 8.21 | 0.88 | 0.65 | 0.06 | 155.5 | 5.3 |
| EXAMPLE 3(CAVITY INCLUDED TYPE) | 8.37 | 0.13 | 0.67 | 0.01 | 149.9 | 5.3 |
| EXAMPLE 4(CAVITY INCLUDED TYPE) | 8.44 | 0.41 | 0.69 | 0.01 | 147.7 | 6.7 |
| EXAMPLE 5(CAVITY INCLUDED TYPE) | 8.31 | 0.43 | 0.65 | 0.03 | 148.7 | 6.3 |
| EXAMPLE 6(CAVITY INCLUDED TYPE) | 8.48 | 0.45 | 0.68 | 0.03 | 149.7 | 5.7 |

*FIG. 16*

| | | CAPSULE OFF | | | | | | | | | | | |
|---|---|---|---|---|---|---|---|---|---|---|---|---|---|
| | | SMOKE DOWNWARD FLOWING POSTURE | | | | | | SMOKE DOWNWARD FLOWING POSTURE | | | | | |
| | | REFERENCE | EXAMPLE 1 | EXAMPLE 2 | EXAMPLE 3 | EXAMPLE 4 | EXAMPLE 5 | REFERENCE | EXAMPLE 1 | EXAMPLE 2 | EXAMPLE 3 | EXAMPLE 4 | EXAMPLE 5 |
| SOMATIC SENSATION | UPPER JAW | -14.0 | -20.5 | -22.0 | -28.2 | -16.9 | -20.9 | -13.5 | 2.9 | 7.4 | 12.9 | 5.2 | 22.5 |
| | TONGUE | -2.2 | 5.4 | 19.1 | 14.3 | 20.8 | 18.9 | -2.0 | -15.5 | -13.5 | -16.3 | -15.2 | -10.0 |
| | THROAT | -5.8 | -0.8 | -9.1 | -6.6 | -15.4 | -3.8 | -5.7 | 0.2 | 5.1 | 18.6 | -8.2 | 20.5 |
| | AIRWAY | -6.3 | 0.2 | -6.6 | -9.8 | -9.7 | -6.9 | -7.1 | 6.9 | -0.5 | 5.4 | -9.8 | -11.5 |
| TASTE | | 6.3 | 1.4 | 6.2 | 2.5 | 13.1 | 12.0 | -3.8 | -9.2 | -0.8 | -8.2 | -3.7 | -7.4 |
| AROMA | | 9.5 | -8.0 | -8.6 | -13.1 | -0.8 | -8.9 | 7.1 | -9.7 | 12.0 | 9.1 | 3.7 | 8.8 |

| | | CAPSULE ON | | | | | | | | | | | |
|---|---|---|---|---|---|---|---|---|---|---|---|---|---|
| | | SMOKE DOWNWARD FLOWING POSTURE | | | | | | SMOKE DOWNWARD FLOWING POSTURE | | | | | |
| | | REFERENCE | EXAMPLE 1 | EXAMPLE 2 | EXAMPLE 3 | EXAMPLE 4 | EXAMPLE 5 | REFERENCE | EXAMPLE 1 | EXAMPLE 2 | EXAMPLE 3 | EXAMPLE 4 | EXAMPLE 5 |
| SOMATIC SENSATION | UPPER JAW | -6.3 | -21.7 | -9.5 | -12.3 | -17.4 | -16.2 | -0.8 | 15.5 | 20.6 | 22.8 | 18.6 | 14.8 |
| | TONGUE | -7.7 | 8.6 | 22.3 | 17.8 | 8.2 | 16.6 | 0.0 | -10.3 | -11.7 | -3.1 | 1.5 | -16.0 |
| | THROAT | -5.1 | 1.8 | -0.9 | 7.1 | -12.6 | -1.1 | -4.6 | 14.2 | 9.7 | 28.5 | 20.9 | 4.8 |
| | AIRWAY | -5.8 | -0.3 | -2.5 | 8.8 | -8.2 | -9.5 | -6.3 | 2.0 | 4.8 | 19.2 | 7.8 | 0.3 |
| TASTE | | 3.8 | 9.5 | 15.5 | 14.9 | 6.2 | 15.5 | 3.2 | -10.9 | 4.2 | 0.6 | -0.9 | -1.8 |
| AROMA | | 0.2 | -6.8 | 5.7 | 3.5 | -4.3 | -0.5 | 8.6 | 0.8 | 14.8 | 21.7 | 26.5 | 16.5 |

FIG. 17

| | LOW AIR FLOW RESISTANCE UNIT SHAPE | SECTIONAL AREA S($mm^2$) | WIDTH DIMENSION W(mm) | BORDERLINE MAXIMUM DISTANCE Dmax (mm) | BORDERLINE MINIMUM DISTANCE Dmin (mm) | EVALUATION |
|---|---|---|---|---|---|---|
| EXAMPLE 7 | CIRCULAR | 3.1 | 2.0 | 2.8 | 0.8 | ○ |
| EXAMPLE 8 | MOON SHAPE・SMALL | 5.2 | 4.0 | 2.1 | 0.1 | ◎ |
| EXAMPLE 9 | MOON SHAPE・SMALL | 5.2 | 4.0 | 2.9 | 0.7 | ◎ |
| EXAMPLE 10 | MOON SHAPE・LARGE | 7.8 | 5.3 | 2.8 | 0.1 | ◎ |
| COMPARATIVE EXAMPLE 1 | CIRCULAR | 3.1 | 2.0 | 1.6 | −0.5 | △ |
| COMPARATIVE EXAMPLE 2 | MOON SHAPE・LARGE | 7.8 | 5.3 | 2.1 | −0.8 | △ |

FILTER FOR CIGARETTE PRODUCT AND CIGARETTE PRODUCT

CROSS-REFERENCE TO RELATED APPLICATIONS

This application is a continuation application of International Application PCT/JP2015/057432 filed on Mar. 13, 2015 and designated the U.S., the entire contents of which are incorporated herein by reference.

TECHNICAL FIELD

The present invention relates to a filter for cigarette product and a cigarette product.

BACKGROUND ART

In a filtered cigarette product, which is one of cigarette products such as a cigarette, an electronic cigarette, and a snuff, methods of changing the fragrance inhaling taste have been known, such as a method of placing an aroma capsule filled with aroma inside the filter (see Patent Document 1, for example), and a method of controlling the amount of air that dilutes mainstream smoke.

[Patent document 1] National Publication of International Patent Application No. 2007-520204

SUMMARY OF INVENTION

Technical Problem

However, when placing the aroma capsule inside the filter, the fragrance inhaling taste is changed by crushing the aroma capsule. This is based on the premise that the aroma delivery amount is changed. Also, after crushing the aroma capsule, it is difficult to bring back the original fragrance inhaling taste. Additionally, while the fragrance inhaling taste changes by controlling the rate (ventilation rate) of air introduced into mainstream smoke through ventilation holes in a tipping paper, this is based on the premise that the amounts of tar and nicotine are changed. Also, this method is not effective in changing the fragrance inhaling taste while smoking according to the smoker's preference. The present invention has been made in view of the above problems, and aims to provide a filter for cigarette product and a technique related to a cigarette product that can reversibly change the fragrance inhaling taste at an arbitrary timing.

Solution to Problem

To solve the above problems, in a mouthpiece end side-filter material of the present invention arranged on the mouthpiece end side of a filter, a low air flow-resistance (pressure drop) unit is arranged in a part of the cross section, and a high air flow-resistance unit is arranged in the remainder of the cross section. At least in a rear end surface of the mouthpiece end side-filter material, the low air flow-resistance unit is arranged only in one semicircular area, of two parts into which the cross section of the mouthpiece end side-filter material is divided.

More specifically, as a first aspect of the present invention, provided is a filter for cigarette product including: a mouthpiece end side-filter material that is arranged on the mouthpiece end side; and a front stage-filter material that is arranged at the front stage of the mouthpiece end side-filter material and filters mainstream smoke, in which: the mouthpiece end side-filter material has a low air flow-resistance unit that is arranged in a part of a cross section from a front end surface to a rear end surface and having a relatively low air flow-resistance, and a high air flow-resistance unit that is arranged in the remainder of the cross section from the front end surface to the rear end surface and having a higher air flow-resistance than the low air flow-resistance unit; and at least on the rear end surface of the mouthpiece end side-filter material, the low air flow-resistance unit is arranged only in one semicircular area, of two parts into which the cross section of the mouthpiece end side-filter material is divided. The present invention can provide a filter for cigarette product that can change the part where the mainstream smoke sucked into the mouth cavity hits, by rotating the filter around the longitudinal axis of the filter by the smoker.

Here, a hollow cavity unit may be provided between the front stage-filter material and the mouthpiece end side-filter material. Thus, it is possible to avoid partial obstruction of the flow of the mainstream smoke in the cross section of the front stage-filter material, when the mainstream smoke passes through the front stage-filter material. Accordingly, it is possible to effectively use the entire section (entire cross section) of the front stage-filter material as a filtering medium of smoke constituents (components).

Also, the high air flow-resistance unit may be formed of a single material. This can reduce the number of steps in the manufacturing process of the filter as compared to forming the high air flow-resistance unit with multiple materials, whereby manufacturing cost can be reduced.

Also, in the mouthpiece end side-filter material, an upstream unit and a downstream unit respectively positioned on the front end side and the rear end side of an intermediate unit, which is positioned between the front end surface and the rear end surface, may be freely rotatable relative to each other. In this case, a slit that is formed in the intermediate unit of the mouthpiece end side-filter material and cut in while leaving a center part of the cross section of the mouthpiece end side-filter material may allow the upstream unit and the downstream unit to freely rotate relative to each other. Accordingly, by rotating the upstream unit and the downstream unit of the mouthpiece end side-filter material relative to each other, the linear velocity of the mainstream smoke flowing into the mouth cavity of the smoker from the mouthpiece end of the filter can be changed. Hence, the intensity of stimulation sensed when smoking can be changed.

Also, the low air flow-resistance unit may be a hollow unit formed from the front end surface to the rear end surface of the mouthpiece end side-filter material. When the low air flow-resistance unit is formed of a hollow unit, the filtering of smoke in the hollow unit is eliminated, whereby the flow of smoke is more easily decentered in a more distinctive manner. Additionally, since the filtering of smoke in the hollow unit is eliminated, it is easier to control the delivery amount of smoke constituents. As a result, this facilitates assurance of values on product labels, for example. Also, identification unit that allows a smoker to identify a position of the low air flow-resistance unit, which is arranged in a decentered manner in the cross section of the mouthpiece end side-filter material, may be provided on an outer peripheral surface of the filter. Hence, the smoker can easily identify the position of the low air flow-resistance unit arranged in a decentered manner in the mouthpiece end side-filter material based on the identification unit. This makes it easier to change the fragrance inhaling taste of the cigarette product when smoking. Also, the mouthpiece end side-filter may be a polygon. The present invention may also be specified as a cigarette product including any of the aforementioned filters for cigarette product.

Note that means for solving the problem of the invention may be adopted in any possible combination.

Advantageous Effects of Invention

The present invention can provide a filter for cigarette product and a cigarette product that can reversibly change the fragrance inhaling taste at an arbitrary timing.

BRIEF DESCRIPTION OF THE DRAWINGS

FIG. 8 is a diagram illustrating fragrance inhaling taste-variable cigarettes of an example.

FIG. 9 is a diagram illustrating a list of measurement results of the amounts of tar and nicotine and the air flow-resistance of the examples and the comparative example.

FIG. 16 is a diagram summarizing results of the sensory evaluations of the cigarettes of Examples 1 to 5.

FIG. 17 is a diagram indicating results of sensory evaluations of cigarettes of Examples 7 to 10.

DESCRIPTION OF EMBODIMENT

Hereinafter, embodiments of a filter for cigarette product of the present invention will be described in detail with reference to the drawings. Dimensions, materials, shapes, relative arrangements and the like of components described in the embodiments do not limit the technical scope of the invention, if not particularly stated otherwise.

Embodiment 1

Figure 1:
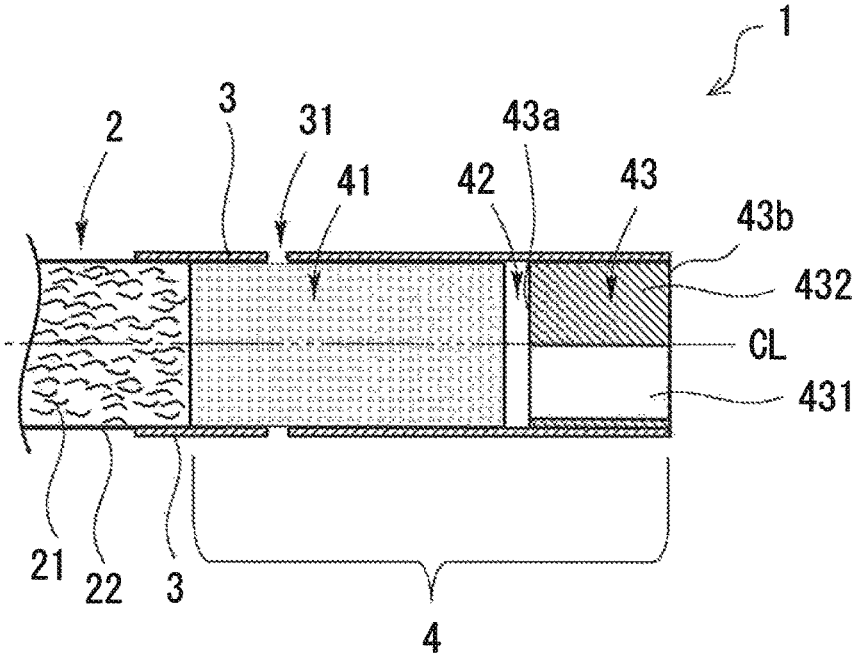
FIG. 1 is a longitudinal section of a cigarette of Embodiment 1.
Figure 2:
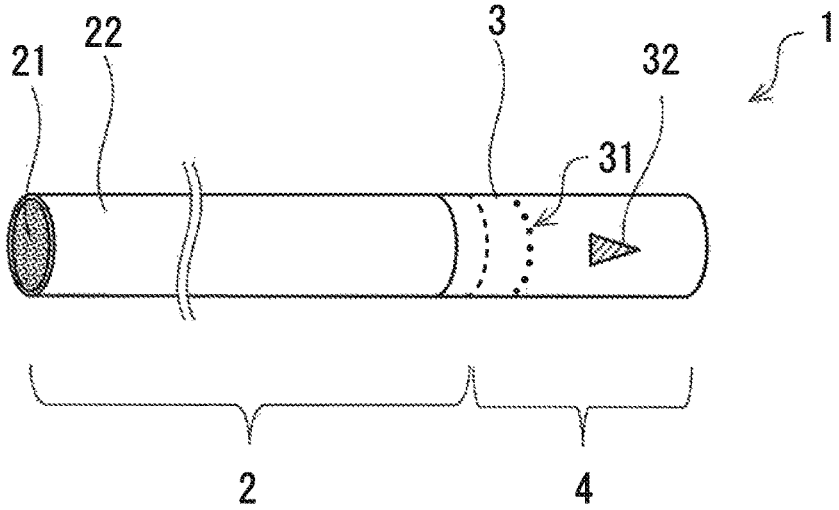
FIG. 2 is an outline drawing of the cigarette of Embodiment 1.

FIG. 1 is a longitudinal section of a cigarette 1 as an example of a cigarette product of Embodiment 1. FIG. 2 is an outline drawing of the cigarette 1 of Embodiment 1. The cigarette 1 includes a cigarette rod 2, and a filter 4 as an example of a filter for cigarette product connected to one end of the cigarette rod 2 through a tipping paper 3.

The cigarette rod 2 is formed into a columnar shape (bar shape) by wrapping tobacco shreds 21 in a cigarette paper 22, and is also referred to as "single roll." The filter 4 is a member for filtering out smoke constituents contained in mainstream smoke, when allowing passage of the mainstream smoke generated at the time of smoking of the cigarette 1. The filter is formed into a columnar shape having substantially the same diameter as the cigarette rod 2.

The filter 4 is a fragrance inhaling taste-variable filter that can reversibly change the fragrance inhaling taste of the cigarette 1 at any timing while smoking. The filter 4 is wrapped in the tipping paper 3, and is connected to the rear end side of the cigarette rod 2 through the tipping paper 3. The tipping paper 3 wraps together the end part of the cigarette rod 2 and the filter 4, to thereby connect (join) the parts. Hereinafter, in the longitudinal direction (axial direction) of the filter 4, an end part connected to the cigarette rod 2 is referred to as a "front end," and an end part opposite to the front end is referred to as a "mouthpiece end (rear end)." A section of the filter 4 cut along the longitudinal direction (axial direction) is defined as a "longitudinal section," and a section cut along a direction orthogonal thereto is defined as a "cross section." Reference sign CL in FIG. 1 indicates a central axis of the cigarette 1 (cigarette rod 2, filter 4).

In the filter 4, a front stage-filter material 41, a cavity unit 42, and a mouthpiece end side-filter material 43 are arranged in this order from the front end side. The cavity unit 42 is a hollow space, and is arranged between the front stage-filter material 41 and the mouthpiece end side-filter material 43.

The front stage-filter material 41 is a filter material in which a cellulose acetate fiber bundle formed into a columnar shape is wrapped with wrapping paper. Note, however, that the front stage-filter material 41 of the embodiment is not limited to the cellulose acetate fiber bundle, and various materials may be used. For example, the front stage-filter material 41 may include an adsorbent (e.g., activated carbon) that adsorbs smoke constituents of mainstream smoke, or other additives. Additionally, other than the filtering of the mainstream smoke, the front stage-filter material 41 may be configured to serve as a mesh that prevents tobacco shreds 21 and other fine powders from entering the mouth part. The front stage-filter material 41 may also include an aromatic material or a plant leaf (e.g., aroma extract, mint leaf).

The mouthpiece end side-filter material 43 is arranged on the mouthpiece end side of the filter 4, and is a filter material in which a cellulose acetate fiber bundle formed into a columnar shape and having a hollow passage 431 formed in the axial direction is wrapped with wrapping paper. The mouthpiece end side-filter material 43 has the hollow passage 431 extending from a front end surface 43*a* to a rear end surface 43*b*.

Figure 3:
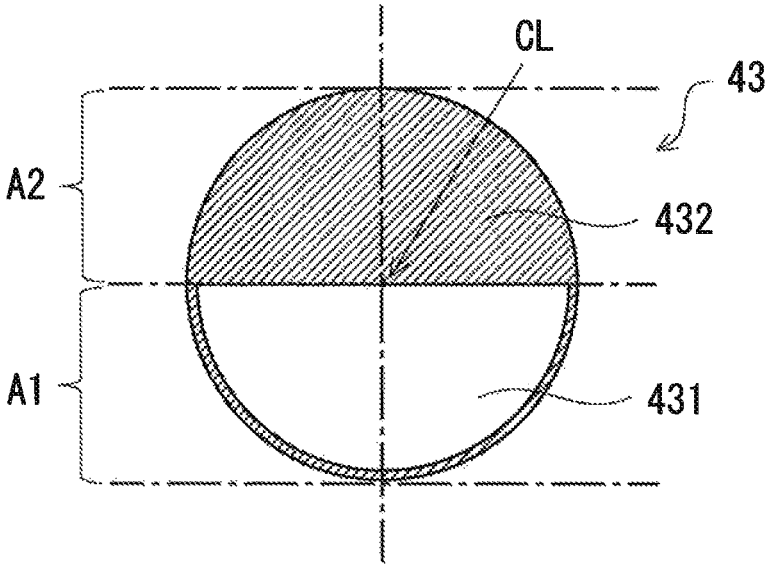
FIG. 3 is a diagram illustrating a cross section of a mouthpiece end side-filter material of Embodiment 1.

FIG. 3 is a diagram illustrating a cross section of the mouthpiece end side-filter material 43 of Embodiment 1. As illustrated in FIG. 3, the mouthpiece end side-filter material 43 has the hollow passage 431 formed in a part of its cross section, and a high air flow-resistance unit 432 formed of the fiber bundle in a part of the cross section. As illustrated in FIG. 3, the hollow passage 431 is a through hole having a semicircular cross section. The hollow passage 431 has a relatively lower air flow-resistance than the high air flow-resistance unit 432 occupied by the formed fiber bundle, and corresponds to a low air flow-resistance unit of the present invention. Note that although the low air flow-resistance unit is formed of the hollow passage 431 in Embodiment 1, it may be formed of a cellulose acetate fiber bundle, for example, which has a relatively lower air flow-resistance than the high air flow-resistance unit 432.

As illustrated in FIG. 3, the mouthpiece end side-filter material 43 is characterized in that it is arranged (exists) only in one first semicircular area A1, of two parts into which its cross section is divided, and is not arranged (not exist) in the other second semicircular area A2. Here, the first semicircular area A1 and the second semicircular area A2 are planar areas, each obtained by dividing the cross section of the mouthpiece end side-filter material 43 into two parts by a central axis CL. In the example illustrated in FIG. 3, of the cross section of the mouthpiece end side-filter material 43, the entire first semicircular area A1 is occupied by the hollow passage 431, and the entire second semicircular area A2 is occupied by the high air flow-resistance unit 432. Since the hollow passage 431 is thus positioned only in the first semicircular area A1 in the mouthpiece end side-filter material 43, the hollow passage 431 is arranged in a decentered manner in the cross section direction of the mouthpiece end side-filter material 43.

Note that in the embodiment, the high air flow-resistance unit 432 in the mouthpiece end side-filter material 43 is formed of a single material, whereby the air flow-resistance of the high air flow-resistance unit 432 is uniform in the cross section direction. In other words, this means that the air flow-resistance does not change in the cross section direction of the high air flow-resistance unit 432.

Here, as illustrated in FIG. 2, air holes 31 that introduce surrounding air for ventilation into the filter 4 and diluting mainstream smoke, are formed in the tipping paper 3 wrapping the filter 4. As illustrated in FIG. 1, the air holes 31 are arranged in a position corresponding to the front stage-filter material 41 in the filter 4. When smoking, outside air flows into the filter 4 through the air holes 31, and the air introduced through the air holes 31 is mixed with mainstream smoke flowing into the filter 4 from the cigarette rod 2 side, and thereby dilutes the mainstream smoke.

Also, as illustrated in FIG. 2, an identification mark 32 is printed on an outer surface of the tipping paper 3 on the mouthpiece end side of the filter 4. The identification mark 32 is identification unit for enabling the smoker to identify the position of the hollow passage 431 arranged in a decentered manner in the cross section of the mouthpiece end side-filter material 43. Although the embodiment adopts the identification mark 32 as the identification unit, various changes may be adopted as long as they are forms that enable the smoker to identify the position of the low air flow-resistance unit (hollow passage 431). An example of such a form is characters printed on the outer surface of the tipping paper 3, or an embossed effect given on the outer surface of the tipping paper 3. Note that although the identification mark 32 is printed on the a section of the outer surface of the tipping paper 3 corresponding to the mouthpiece end side-filter material 43 in the axial direction (longitudinal direction) of the filter 4 in the embodiment, the arrangement position of the identification mark 32 in the axial direction of the filter 4 is not particularly limited, and the identification mark 32 may be printed on a section of the outer surface of the tipping paper 3 corresponding to the front stage-filter material 41 or the cavity unit 42, for example. Examples of other identification unit include, when forming the low air flow-resistance unit of the cross section of the mouthpiece end side-filter material 43 of the filter 4 by a filter material that has a lower air flow-resistance than the high air flow-resistance unit 432, a form of coloring respective filter members of the low air flow-resistance unit and the high air flow-resistance unit in different colors, a form of coloring just one of them, and a form of using a colored paper for the wrapping paper (i.e., part of low air flow-resistance unit that is border with high air flow-resistance unit) used to form the low air flow-resistance unit. When forming the low air flow-resistance unit of the mouthpiece end side-filter material 43 by the hollow passage 431, the identification unit may be provided arbitrarily and appropriately, such as by coloring the high air flow-resistance unit 432 positioned on the circumference of the hollow passage 431.

When smoking, the cigarette 1 configured in the above manner is smoked by the smoker, after mainstream smoke generated in a fire source unit of the cigarette rod 2 passes through the filter 4. The mainstream smoke flowed into the filter 4 from the cigarette rod 2 sequentially passes through the front stage-filter material 41, cavity unit 42, and mouthpiece end side-filter material 43, and is sucked into the mouth cavity of the smoker from the mouthpiece end. At this time, when the mainstream smoke having flowed into the filter 4 passes through the front stage-filter material 41, smoke constituents such as tar and nicotine are filtered out. Also, the outside air introduced into the filter 4 through the air holes 31 pierced in the tipping paper 3 is mixed with the mainstream smoke passing through the front stage-filter material 41, whereby tar, nicotine, CO and other components contained in the mainstream smoke are diluted.

Then, the mainstream smoke having passed the front stage-filter material 41 and the cavity unit 42 flows through the hollow passage 431 in the mouthpiece end side-filter material 43, and is sucked into the mouth cavity of the smoker. Since the hollow passage 431 of the mouthpiece end side-filter material 43 of the embodiment is arranged in a decentered manner in the cross section direction, the mainstream smoke can be guided into the mouth cavity of the smoker with a degree of directionality. Accordingly, when smoking the cigarette 1, the smoker can arbitrarily change the part where the mainstream smoke guided into the mouth cavity hits, by changing the posture (direction, position) of holding the filter 4 in his/her mouth. Specifically, the smoker can change the part where the mainstream smoke sucked into the mouth cavity hits, by rotating the filter 4 around its longitudinal axis (central axis CL) (i.e., rotate filter 4 in its circumferential direction). Particularly, since the hollow passage 431 in the embodiment is arranged only in the one first semicircular area A1, of two parts into which the cross section of the mouthpiece end side-filter material 43 is divided, and is not arranged in the other second semicircular area A2, the smoker can more distinctively change the part where the mainstream smoke sucked into the mouth cavity hits, when rotating the filter 4 around the longitudinal axis (central axis CL).

Figure 4A:
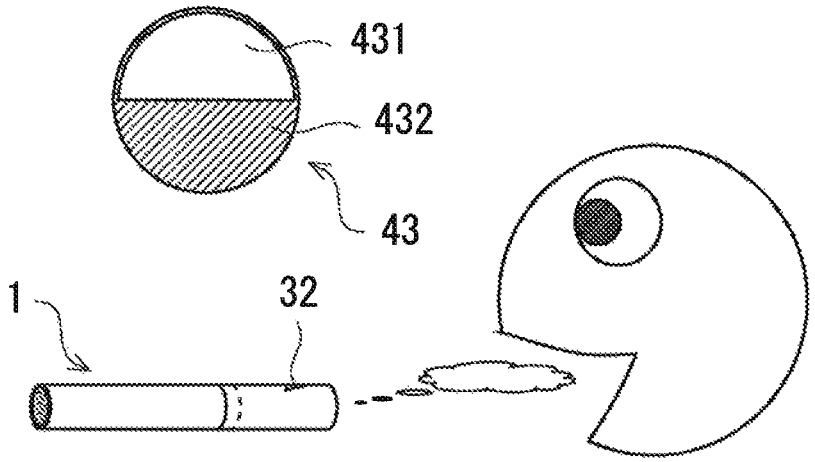
FIG. 4A is a diagram describing how to smoke with a filter of Embodiment 1 held in the mouth in a smoke upward-flowing posture.
Figure 4B:
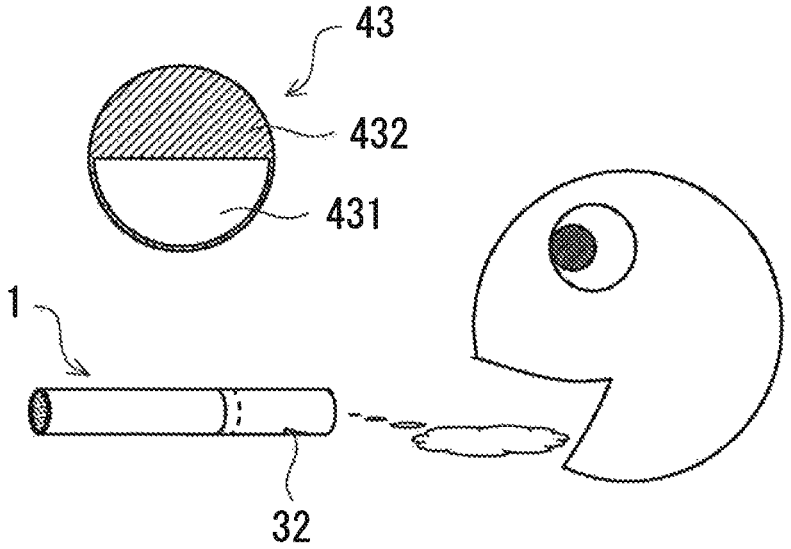
FIG. 4B is a diagram describing how to smoke with the filter of Embodiment 1 held in the mouth in a smoke downward-flowing posture.

For example, as illustrated in FIG. 4A, by smoking with the filter 4 held in the mouth in a posture where the hollow passage 431 of the mouthpiece end side-filter material 43 is positioned in the direction of the upper jaw and the throat (hereinafter referred to as "smoke upward-flowing posture"), the mainstream smoke is allowed to flow into the mouth cavity in the upper direction, and is mainly guided toward the upper jaw. On the other hand, FIG. 4B illustrates a state in which the cigarette 1 (filter 4) is vertically inverted from the smoke upward-flowing posture in FIG. 4A, and the filter 4 is held in the mouth in a posture where the hollow passage 431 of the mouthpiece end side-filter material 43 is positioned in the direction of the tongue (hereinafter referred to as "smoke downward-flowing posture"). As illustrated in FIG. 4B, when smoking with the filter 4 held in the mouth in the smoke downward-flowing posture, the mainstream smoke is allowed to flow into the mouth cavity in the lower direction, and is mainly guided toward the tongue. Note that the smoke upward-flowing posture and the smoke downward-flowing posture when smoking can be switched by inverting the direction in which to hold the cigarette 1 in the mouth for 180 degrees around the longitudinal axis of the cigarette 1 (filter 4).

A human upper jaw has many olfactory receptors that sense aroma (smell). Meanwhile, a human tongue has many taste receptors that sense taste. According to the cigarette 1 of the embodiment, the smoker can freely change the part where the mainstream smoke introduced into the mouth cavity hits, by rotating the filter 4 around the longitudinal axis (central axis CL) according to his/her preference or feeling. In other words, in the above example, the smoker can sense a strong aroma and stimulation (somatic sensation) to the upper jaw and throat, by smoking with the filter 4 held in the mouth in the smoke upward-flowing posture illustrated in FIG. 4A. On the other hand, the smoker can sense a strong taste and stimulation (somatic sensation) to the tongue, by smoking with the filter 4 held in the mouth in the smoke downward-flowing posture illustrated in FIG. 4B.

Additionally, according to the cigarette 1 of the embodiment, since the rate (ventilation rate) of air introduced into the mainstream smoke through the air holes 31 in the tipping paper 3 do not change with a change in the posture of holding the filter 4 in the mouth when smoking, changes in the amounts of tar and nicotine (TN amount) can be suppressed. Also, there is no aroma capsule arranged in the filter 4 illustrated in FIG. 1. Hence, unlike any conventional technique of changing the fragrance inhaling taste by changing the TN amount and aroma delivery amount when smoking, the cigarette 1 of the embodiment achieves the change in the fragrance inhaling taste by a unique method of changing the position where the mainstream smoke hits in the mouth cavity. Note that in the filter 4 of the embodiment, too, a crushable aroma capsule filled with aroma may be placed inside the filter 4, as a matter of course.

Moreover, according to the cigarette 1 of the embodiment, the smoker can change the position of holding the filter 4 in his/her mouth at an arbitrary timing while smoking, by rotating the filter 4 around the longitudinal axis (central axis CL) thereof. This changes the part where the mainstream smoke hits in the mouth cavity when the mainstream smoke is sucked into the mouth cavity, so that the smoker can enjoy a change in the fragrance inhaling taste when smoking. For example, various ways of smoking can be achieved, such as switching the posture of the filter 4 from the smoke upward-flowing posture to the smoke downward-flowing posture to shift to a state (this state is hereinafter referred to as "taste rich state") where the stimulation of taste is made larger than the stimulation of aroma, and then bringing the posture of the filter 4 back to the smoke upward-flowing posture to shift to a state (this state is hereinafter referred to as "aroma rich state") where the stimulation of aroma is made larger than the stimulation of taste. Since the taste rich state and the aroma rich state can be switched easily by switching the posture of holding the filter 4 in the mouth between the smoke upward-flowing posture and the smoke downward-flowing posture while smoking, the filter 4 of the embodiment is capable of reversibly changing the fragrance inhaling taste. Note that capable of reversibly changing the fragrance inhaling taste means to be capable of freely switching the fragrance inhaling taste of the cigarette 1 between the taste rich state and the aroma rich state, when smoking.

As has been described, according to the filter 4 of the embodiment, the fragrance inhaling taste can be reversibly changed at an arbitrary timing, without changing the aroma delivery amount or amounts of tar and nicotine while smoking. Note that in the embodiment, the identification mark 32 is printed on the outer surface of the tipping paper 3, and the smoker can easily identify the position of the hollow passage 431 arranged in a decentered manner in the cross section of the mouthpiece end side-filter material 43 based on the identification mark 32. This makes it easier to change the fragrance inhaling taste of the cigarette 1 when smoking.

Moreover, according to the filter 4 of the embodiment, the high air flow-resistance unit 432 of the mouthpiece end side-filter material 43 is formed of a single material, and has a uniform air flow-resistance in the cross section direction. Hence, the number of steps in the manufacturing process of the filter 4 can be reduced as compared to forming the high air flow-resistance unit 432 with multiple materials, whereby manufacturing cost can be reduced.

Figure 5:
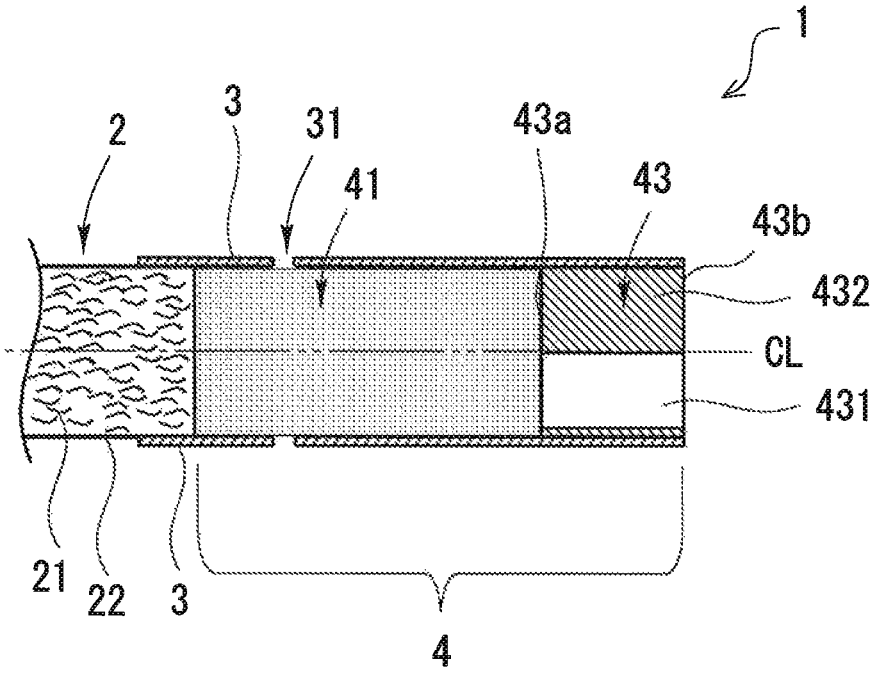
FIG. 5 is a longitudinal section of a cigarette of a modification of Embodiment 1.

Furthermore, in the filter 4 of the embodiment, the hollow cavity unit 42 is arranged between the front stage-filter material 41 and the mouthpiece end side-filter material 43. This allows the mainstream smoke having flowed through the entire cross section (entire area) of the front stage-filter material 41 to flow out as it is into the cavity unit 42, without narrowing the flow path. Then, the cavity unit 42 can be used to function as a buffer of the mainstream smoke, to allow the mainstream smoke to flow into the hollow passage 431 of the mouthpiece end side-filter material 43 from the cavity unit 42. Thus, it is possible to avoid partial obstruction of the flow of the mainstream smoke in the cross section of the front stage-filter material 41, when the mainstream smoke passes through the front stage-filter material 41. In other words, it is possible to effectively use the entire section (entire cross section) of the front stage-filter material 41 as a filtering medium of smoke constituents. Note, however, that the front end of the mouthpiece end side-filter material 43 may be connected to the rear end of the front stage-filter material 41, without providing the cavity unit 42 between the front stage-filter material 41 and the mouthpiece end side-filter material 43 as in a modification illustrated in FIG. 5.

Various variations may be adopted as the configuration of the mouthpiece end side-filter material 43. Hereinafter, variations of the mouthpiece end side-filter material 43 of the embodiment will be described. FIGS. 6A to 6F are diagrams illustrating variations of the mouthpiece end side-filter material 43 of the embodiment.

Figure 6A:
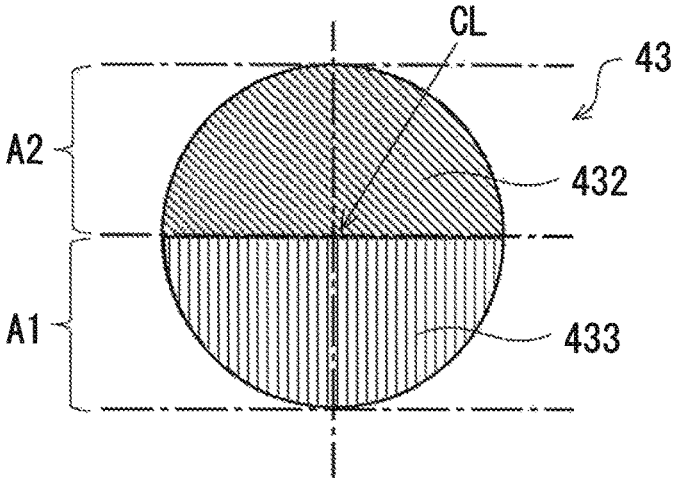
FIG. 6A is a diagram illustrating a variation of the mouthpiece end side-filter material of Embodiment 1 (1).

A mouthpiece end side-filter material 43 illustrated in FIG. 6A is different from the mouthpiece end side-filter material 43 illustrated in FIG. 3, in that a low air flow-resistance unit 433 having a semicircular cross section is formed instead of the hollow passage 431, in one first semicircular area A1, of two parts into which the cross section of the mouthpiece end side-filter material 43 is divided. The low air flow-resistance unit 433 has a relatively lower air flow-resistance than a high air flow-resistance unit 432 arranged in a second semicircular area A2. Since the low air flow-resistance unit 433 and the high air flow-resistance unit 432 having different air flow-resistances are provided in the cross section of the mouthpiece end side-filter material 43, mainstream smoke having flowed into the mouthpiece end side-filter material 43 passes through the low air flow-resistance unit 433 having a lower air flow-resistance than the high air flow-resistance unit 432, and is sucked into the mouth cavity from the mouthpiece end. Accordingly, by changing the posture of a filter 4 while smoking to an arbitrary posture at an arbitrary timing, a part where the mainstream smoke sucked into the mouth cavity hits is changed, so that the fragrance inhaling taste while smoking can be changed.

Figure 6B:
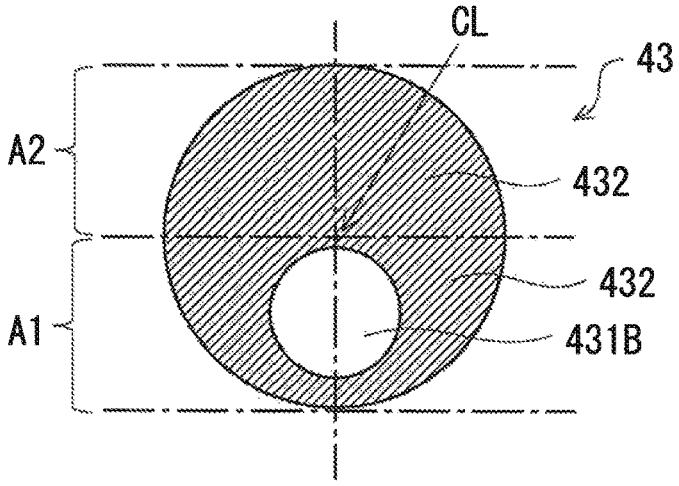
FIG. 6B is a diagram illustrating a variation of the mouthpiece end side-filter material of Embodiment 1 (2).
Figure 6C:
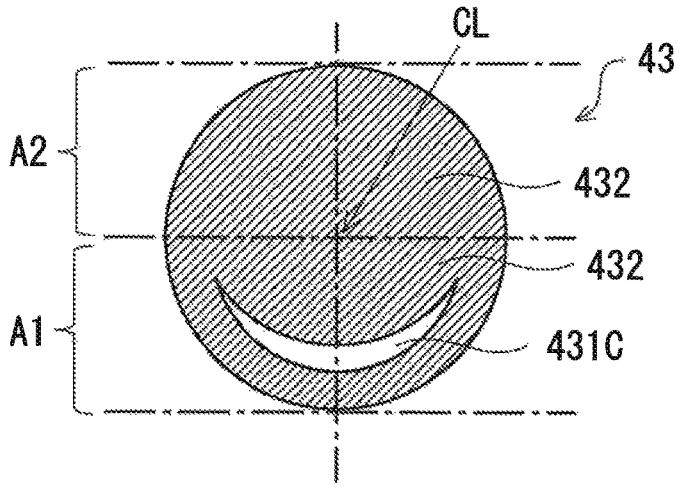
FIG. 6C is a diagram illustrating a variation of the mouthpiece end side-filter material of Embodiment 1 (3).
Figure 6D:
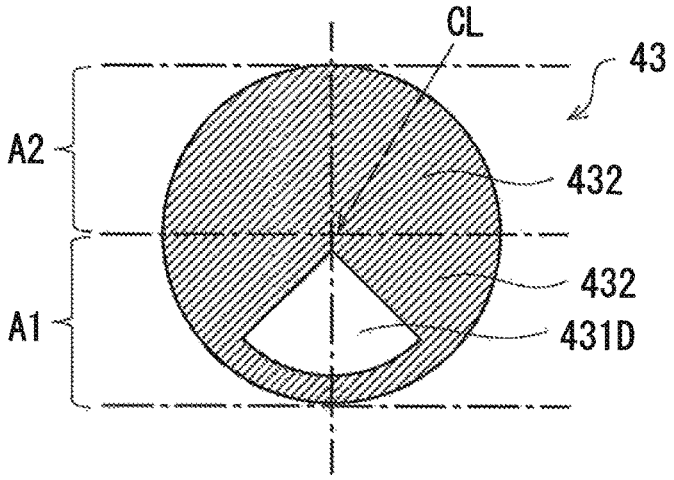
FIG. 6D is a diagram illustrating a variation of the mouthpiece end side-filter material of Embodiment 1 (4).

In mouthpiece end side-filter materials 43 illustrated in FIGS. 6B to 6F, hollow passages 431B to 431F having shapes different from the hollow passage 431 illustrated in FIG. 3 are formed in first semicircular areas A1. In the mouthpiece end side-filter material 43 illustrated in FIG. 6B, the single hollow passage 431B having a circular section is formed only in a first semicircular area A1. In the mouthpiece end side-filter material 43 illustrated in FIG. 6C, the single hollow passage 431C having a moon-shaped section is formed only in a first semicircular area A1. In the mouthpiece end side-filter material 43 illustrated in FIG. 6D, the single hollow passage 431D having a fan-shaped (sectoral) section is formed only in a first semicircular area A1. In the example of FIG. 6D, the sectional shape of the hollow passage 431D is a quarter circle (interior angle of hollow unit is 90 degrees).

Figure 6E:
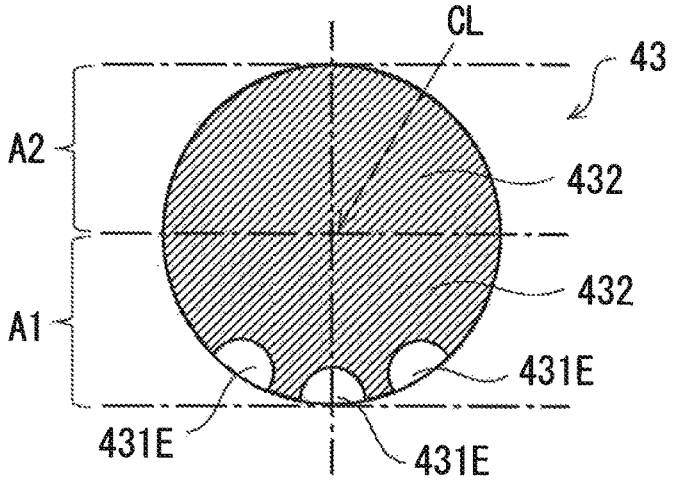
FIG. 6E is a diagram illustrating a variation of the mouthpiece end side-filter material of Embodiment 1 (5).
Figure 6F:
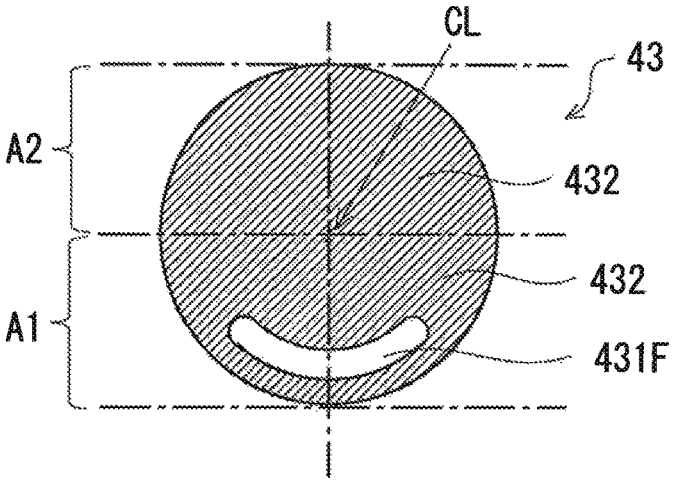
FIG. 6F is a diagram illustrating a variation of the mouthpiece end side-filter material of Embodiment 1 (6).

In the mouthpiece end side-filter material 43 illustrated in FIG. 6E, the multiple hollow passages 431E having semicircular sections are formed only in a first semicircular area A1. In the example of FIG. 6E, all of the three hollow passages 431E are arranged in the first semicircular area A1. In the mouthpiece end side-filter material 43 illustrated in FIG. 6F, the hollow passage 431F is formed only in a first semicircular area A1. As has been described, the shape, size, number and other characteristics of the hollow passage 431F formed in the mouthpiece end side-filter material 43 may be changed as appropriate. Each of the hollow passages 431B to 431F of the mouthpiece end side-filter materials 43 of FIGS. 6B to 6F is also exchangeable with a low air flow-resistance unit formed of a filter material having a relatively lower air flow-resistance than the high air flow-resistance unit 432. That is, the low air flow-resistance unit may be formed of a hollow unit, or may be formed of a filter material having a lower air flow-resistance than the filter material forming the high air flow-resistance unit. When the low air flow-resistance unit is formed of a hollow unit as in the former example, the filtering of smoke in the hollow unit is eliminated, whereby the flow of smoke is more easily decentered in a more distinctive manner. Also, since the filtering of smoke in the hollow unit is eliminated, it is easier to control the delivery amount of smoke constituents. As a result, this, for example, facilitates assurance of values on product labels. Meanwhile, when the low air flow-resistance unit is formed of a filter material having a low air flow-resistance as in the latter example, there is an advantage that the mouthpiece end side-filter material 43, too can be used to filter the mainstream smoke. The shape of the mouthpiece end side-filter material 43 in the filter 4 is not limited to a columnar shape, and may be a polygon.

Note that the hollow passage 431 (low air flow-resistance unit) of the mouthpiece end side-filter material 43 of the embodiment may at least be arranged only in one first semicircular area A1, of two parts into which its cross section is divided, in a position on the rear end surface 43*b* (mouthpiece end). Since the hollow passage 431 (low air flow-resistance unit) is arranged at least in a decentered manner in the first semicircular area A1 in a position on the rear end surface 43*b* (mouthpiece end) of the mouthpiece end side-filter material 43, the smoker can change the fragrance inhaling taste of the cigarette 1, by appropriately rotating the filter 4 around the longitudinal axis (central axis CL), and changing the part where the mainstream smoke hits in the mouth cavity.

Figure 6G:
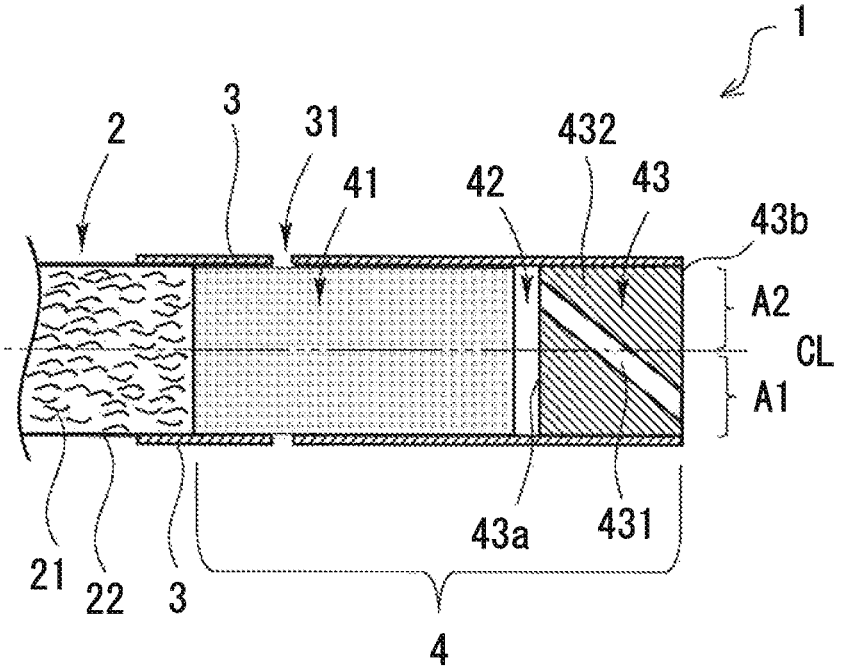
FIG. 6G is a longitudinal section of a cigarette of another modification of Embodiment 1.

Additionally, although the hollow passage 431 (low air flow-resistance unit) of the mouthpiece end side-filter material 43 is arranged parallel to the longitudinal axis (central axis) of the filter 4 from the front end surface 43*a* to the rear end surface 43*b* of the mouthpiece end side-filter material 43 in the example illustrated in FIG. 1, the embodiment is not limited to this. For example, as in a modification illustrated in FIG. 6G, the longitudinal axis of the hollow passage 431 (low air flow-resistance unit) of the mouthpiece end side-filter material 43 may be arranged such that it is tilted with respect to the longitudinal axis (central axis CL) of the filter 4. In the example illustrated in FIG. 6G, the rear end position of a hollow passage 431 (low air flow-resistance unit) is arranged only in a first semicircular area A1, in a position on a rear end surface 43*b* (mouthpiece end) of a mouthpiece end side-filter material 43. Also, the front end position of the hollow passage 431 (low air flow-resistance unit) is arranged only in a second semicircular area A2, in a position on a front end surface 43*a* of the mouthpiece end side-filter material 43. By arranging the longitudinal axis of the hollow passage 431 (low air flow-resistance unit) of the mouthpiece end side-filter material 43 such that it is tilted with respect to the longitudinal axis (central axis CL) of the filter 4 as illustrated in FIG. 6G, the smoker can more distinctively change the part where the mainstream smoke sucked in from the rear end surface 43*b* (mouthpiece end) of the mouthpiece end side-filter material 43 hits in the mouth cavity, before and after rotating the filter 4 around the longitudinal axis (central axis CL). As a result, the smoker can more distinctively change the fragrance inhaling taste of the cigarette 1, according to the smoker's preference.

Example

Although the present invention will next be described more specifically by use of examples, the invention is not limited to descriptions of the following examples, as long as it is within the gist of the invention.

<<Measurement of Amounts of Tar and Nicotine and Air Flow-Resistance>>

Figure 7:
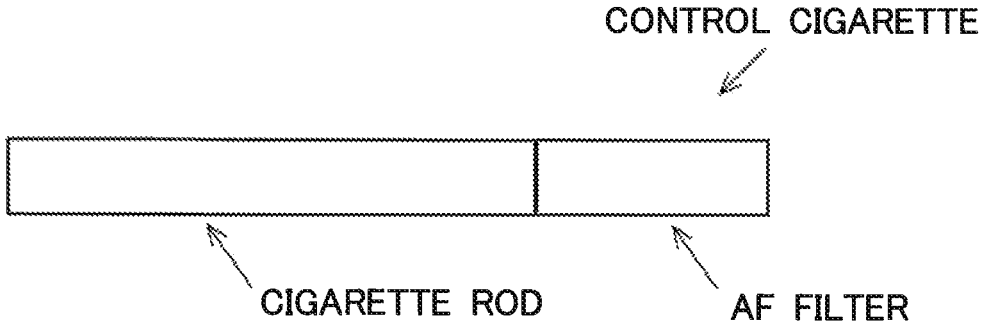
FIG. 7 is a diagram illustrating a control cigarette of a comparative example.

Samples of a cigarette of an example were created, and the tar amount, nicotine amount, and the air flow-resistance were measured. FIG. 7 is a diagram illustrating a standard cigarette (control cigarette) of a comparative example. A filter of the control cigarette illustrated in FIG. 7 is a general cellulose acetate filter (hereinafter also referred to as "AF filter"), whose filter overall length is 27 mm, and outer diameter is 7.2 mm. Meanwhile, FIG. 8 is a diagram illustrating fragrance inhaling taste-variable cigarettes of the example. A filter 4 of the fragrance inhaling taste-variable cigarette was created by connecting, to the rear end of a control filter (AF filter), a tubular paper tube 5 including a mouthpiece end side-filter material 43 adhered to an inner surface thereof. In FIG. 8, the upper part indicates a "cavity unit included-type", and the lower part indicates a "cavity unit not included-type".

The cavity unit included-type was formed by attaching, subsequent to the AF filter, a 5 mm-long mouthpiece end side-filter material 43 adhered to an inner surface of a 7 mm-long paper tube 5 with CMC paste. In the cavity unit included-type, a 2 mm-long cavity unit 42 is formed between a rear end surface of the AF filter and a front end surface of the mouthpiece end side-filter material 43. The cavity unit not included-type was formed by attaching, subsequent to the AF filter, a 7 mm-long mouthpiece end side-filter material 43 adhered to an inner surface of a 7 mm-long paper tube 5 with CMC paste. In the cavity unit not included-type, a rear end surface of the AF filter and a front end surface of the mouthpiece end side-filter material 43 are brought together and connected with no space in between. Note that the paper tube 5 was connected to the AF filter with tape. Of the mouthpiece end side-filter material 43, a high air flow-resistance unit 432 is formed of a 2.2Y/44000 cellulose acetate fiber, a low air flow-resistance unit 433 is formed of an 8.6Y/21000 cellulose acetate fiber, and the material was prepared by setting the triacetin content on the high air flow-resistance unit side to 23%.

FIG. 9 illustrates a list of measurement results of the amounts of tar and nicotine and the air flow-resistance of the cigarettes of the examples and comparative example. In Examples 1 to 6 of FIG. 9, mouthpiece end side-filter materials 43 have different specifications. A mouthpiece end side-filter material 43 of Example 1 corresponds to the mouthpiece end side-filter material 43 illustrated in FIG. 6A, where the semicircular low air flow-resistance unit 433 is arranged in the first semicircular area A1, and the high air flow-resistance unit 432 is arranged in the second semicircular area A2. The inner diameter (diameter) of the low air flow-resistance unit 433 was set to 5.2 mm. Only the cavity unit included-type was set for Example 1.

A mouthpiece end side-filter material 43 of Example 2 corresponds to the mouthpiece end side-filter material 43 illustrated in FIG. 6B, where the single hollow passage 431B having a circular section is formed only in the first semicircular area A1. Here, the inner diameter (diameter) of the hollow passage 431B was set to 3 mm, and the thickness dimension (hereinafter referred to as "high air flow-resistance unit minimum thickness") of a part of the high air flow-resistance unit 432 having the minimum thickness was set to 1 mm. Both the cavity unit included-type and the cavity unit not included-type were prepared for Example 2.

A mouthpiece end side-filter material 43 of Example 3 corresponds to the mouthpiece end side-filter material 43 illustrated in FIG. 6C, where the hollow passage 431C having a moon-shaped section is formed only in the first semicircular area A1. In Example 3, the high air flow-resistance unit minimum thickness in the mouthpiece end side-filter material 43 was set to 1.4 mm. Both the cavity unit included-type and the cavity unit not included-type were prepared for Example 3, too.

A mouthpiece end side-filter material 43 of Example 4 corresponds to the mouthpiece end side-filter material 43 illustrated in FIG. 3, where the semicircular hollow passage 431 is formed such that it occupies the entire first semicircular area A1. The inner diameter (diameter) of the hollow passage 431 was set to 5.2 mm. Only the cavity unit included-type was set for Example 4.

A mouthpiece end side-filter material 43 of Example 5 corresponds to the mouthpiece end side-filter material 43 illustrated in FIG. 6D, where the hollow passage 431D having a fan-shaped section is formed only in the first semicircular area A1. The interior angle of the hollow passage 431D was set to 90 degrees (quarter circle). In Example 5, the high air flow-resistance unit minimum thickness in the mouthpiece end side-filter material 43 was set to 1 mm. Only the cavity unit included-type was set for Example 5.

Next, a mouthpiece end side-filter material 43 of Example 6 corresponds to the mouthpiece end side-filter material 43 illustrated in FIG. 6E, where the three hollow passages 431E having semicircular sections are formed only in the first semicircular area A1. In Example 6, the high air flow-resistance unit minimum thickness in the mouthpiece end side-filter material 43 was set to 0 mm, and the inner diameter (diameter) of the hollow passage 431E was set to 1.5 mm. Only the cavity unit included-type was set for Example 6.

Three samples were created for cigarettes of each of the above examples and the comparative example, and the amounts of tar and nicotine and the air flow-resistance were measured under the following conditions and environment. Specifically, the samples were set to an automatic smoking machine (SM 410, manufactured by SERULEAN) under the environment of 22 degrees C. room temperature, 60% relative humidity, and 0.2 m/second wind speed, and were smoked according to the ISO standard smoking conditions (repeat action of smoking 35 ml for 2 seconds in a single empty puff at 58 second intervals per burn-type smoking article). Of the mainstream smoke, particulate phase constituents were collected by use of a Cambridge filter (borgwaldt, 400 Filter 44 mm), and gas phase constituents were collected by use of a gas bag (SUPELCO, Tedlar Bag). As for the particulate phase constituents, after calculating the TPM (Total Particular Matter) from a change in weight of the Cambridge filter, shake extraction was performed for 20 minutes by use of 10 ml of Isopropanol, and the amounts of water and nicotine were measured by use of GC-FID/TCD (6890N, Agilent) to calculate the amount of tar. The air flow-resistance was measured in the usual way by use of the air flow-resistance measurement device PV21 (created by JT Toshi, Inc.).

As indicated in FIG. 9, it has been found that none of the amount of tar, the amount of nicotine, and the air flow-resistance varies largely between the cigarettes of Examples 1 to 6 and the cigarette of the comparative example.

<<Sensory Evaluation Test>>

Next, effects related to the change in the fragrance inhaling taste when smoking the cigarette of the example were evaluated, based on the following sensory evaluation test. The sensory evaluation test was performed for the aforementioned Examples 1 to 5 and the reference cigarette. The reference cigarette was formed by adding, to the AF filter of the control cigarette described in FIG. 7, a center hole that penetrates the AF filter in the axial direction. Note that the center hole of the filter of the reference cigarette is concentric with the central axis of the filter. In addition, the cigarettes of Examples 1 to 5 and the reference cigarette used in the sensory evaluation test each has a capsule filled with aroma, placed inside the filter.

The sensory evaluation was made by making five evaluators (A to E) smoke each of the cigarettes of s 1 to 5 and the reference cigarette, and evaluating the difference in the fragrance inhaling taste, which was obtained when the way of holding the filter in the mouth was vertically inverted. Note that when smoking the cigarettes of Examples 1 to 5, the smoke upward-flowing posture illustrated in FIG. 4A and the smoke downward-flowing posture illustrated in FIG. 4B were switched while smoking. Evaluation items of the sensory evaluation were the intensity of "taste," "aroma," and "somatic sensation (stimulation)," which were evaluated by using five stages including "very weak," "weak," "adequate," "strong," and "very strong," in free scale. In particular, the intensity of somatic sensation (stimulation) was evaluated for each of parts including "upper jaw," "tongue," "throat," and "airway." In the sensory evaluation test, the intensity of taste, aroma, and somatic sensation (stimulation) were evaluated, by smoking with the filter held in the mouth in each of postures of the smoke upward-flowing posture and the smoke downward-flowing posture. Each value of the evaluation items in FIGS. 10 to 15 was plotted as a mean value of the five evaluators. Each item was evaluated based on the five levels of evaluation including "very weak," "weak," "adequate," "strong," and "very strong." Note that the evaluation was made by giving −50 for "very weak," −25 for "weak," 0 for "adequate," 25 for "strong," and 50 for "very strong," regarding the sensation when vertically inverting the cigarette.

Figure 10:
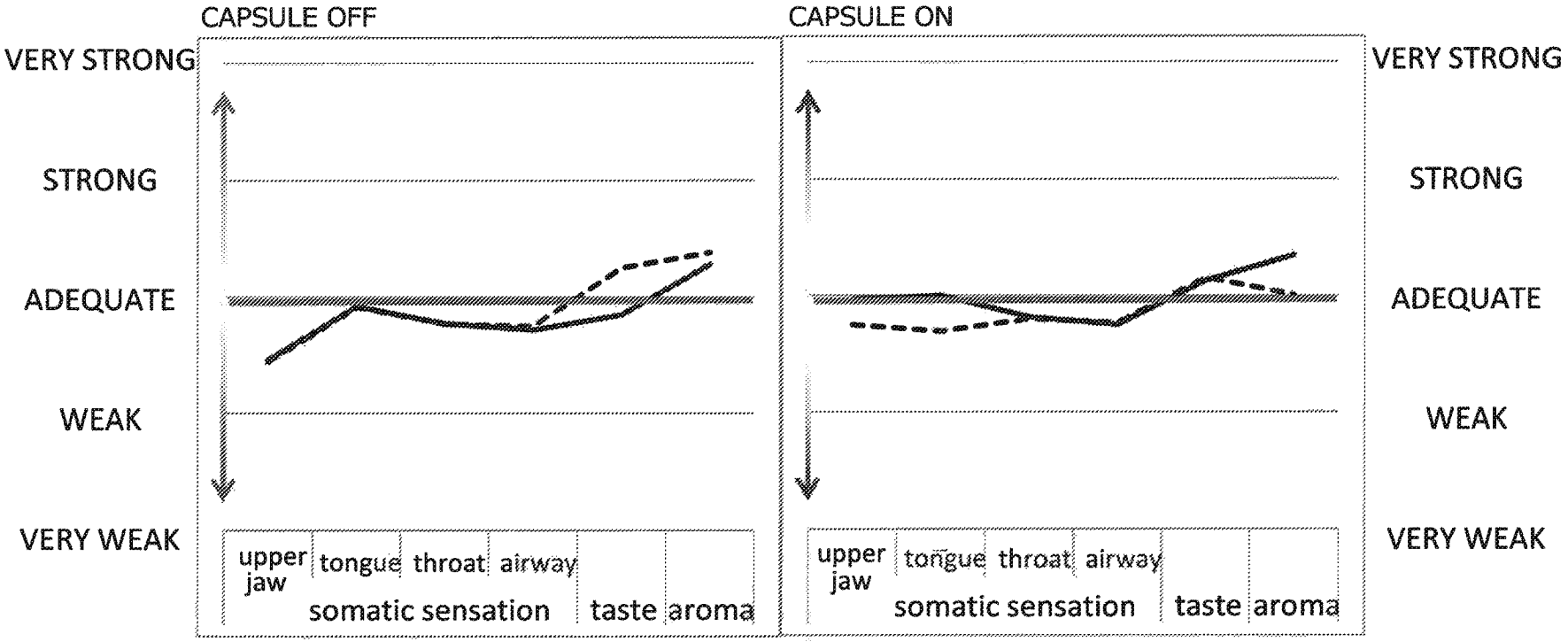
FIG. 10 is a graph illustrating a sensory evaluation result of a reference cigarette of the comparative example.
Figure 11:
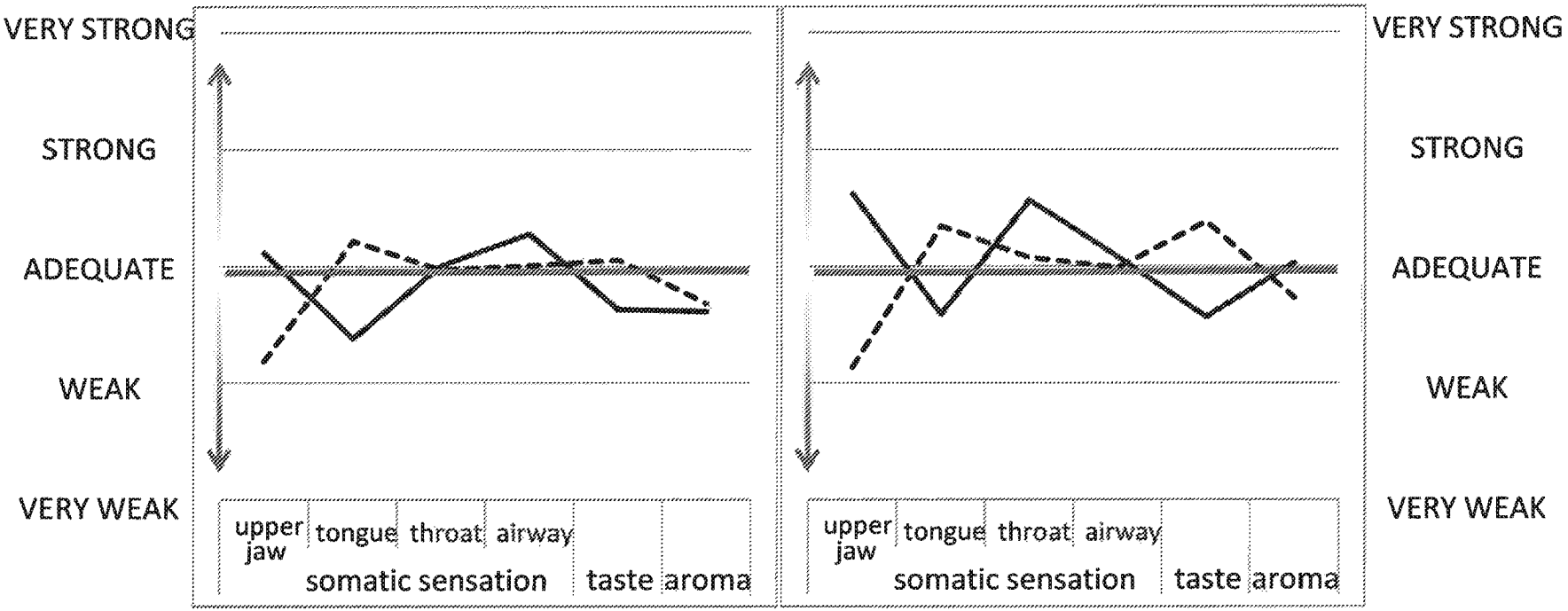
FIG. 11 is a graph illustrating a sensory evaluation result of a cigarette of Example 1.
Figure 12:
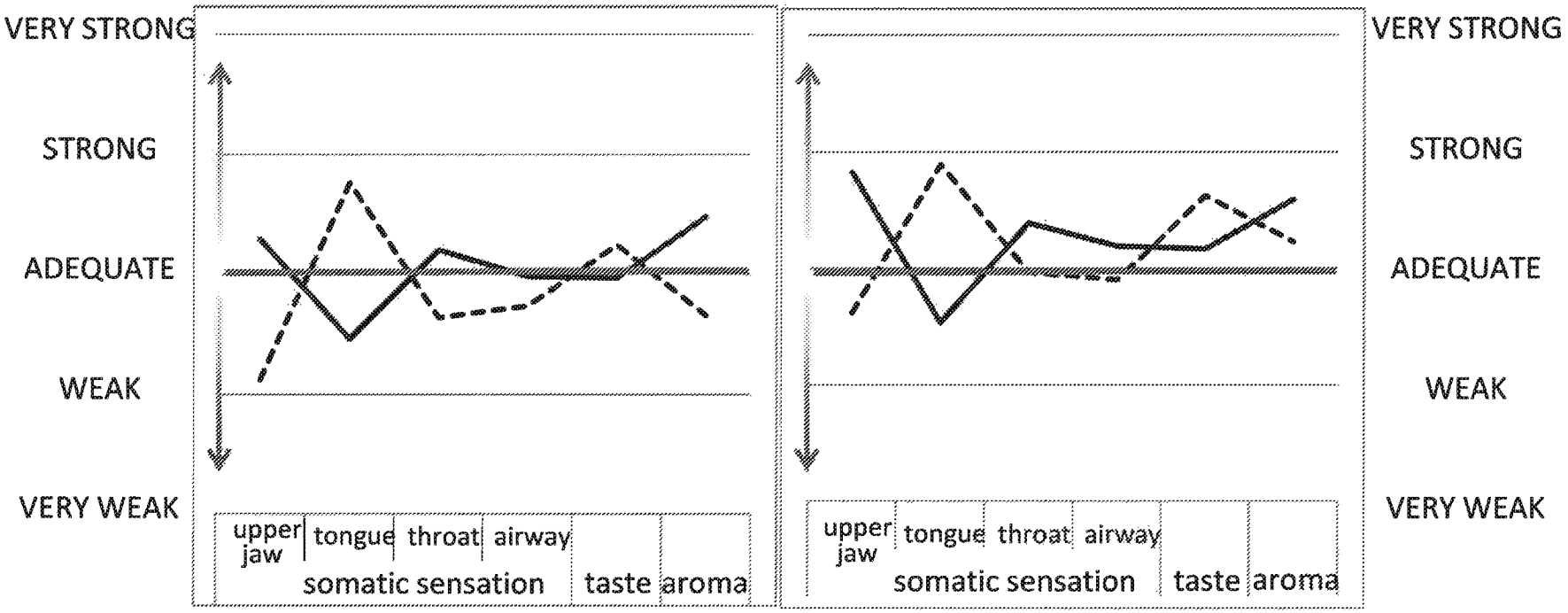
FIG. 12 is a graph illustrating a sensory evaluation result of a cigarette of Example 2.
Figure 13:
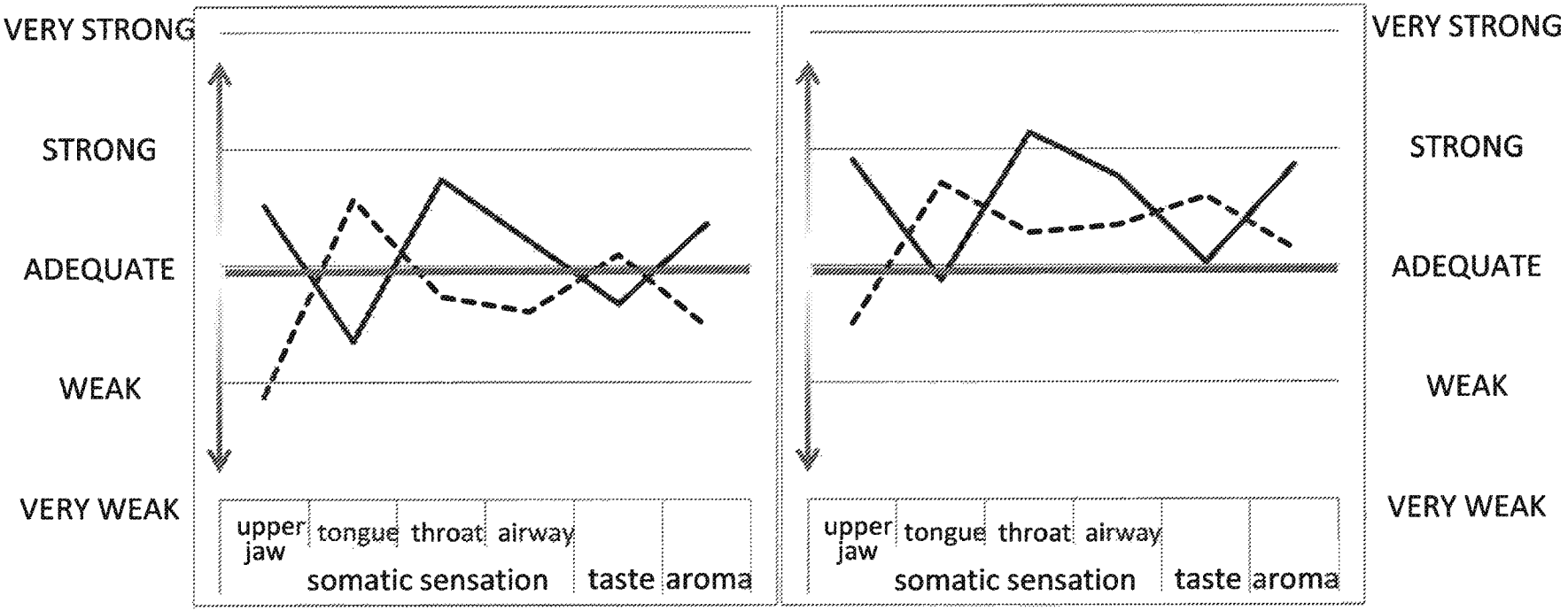
FIG. 13 is a graph illustrating a sensory evaluation result of a cigarette of Example 3.
Figure 14:
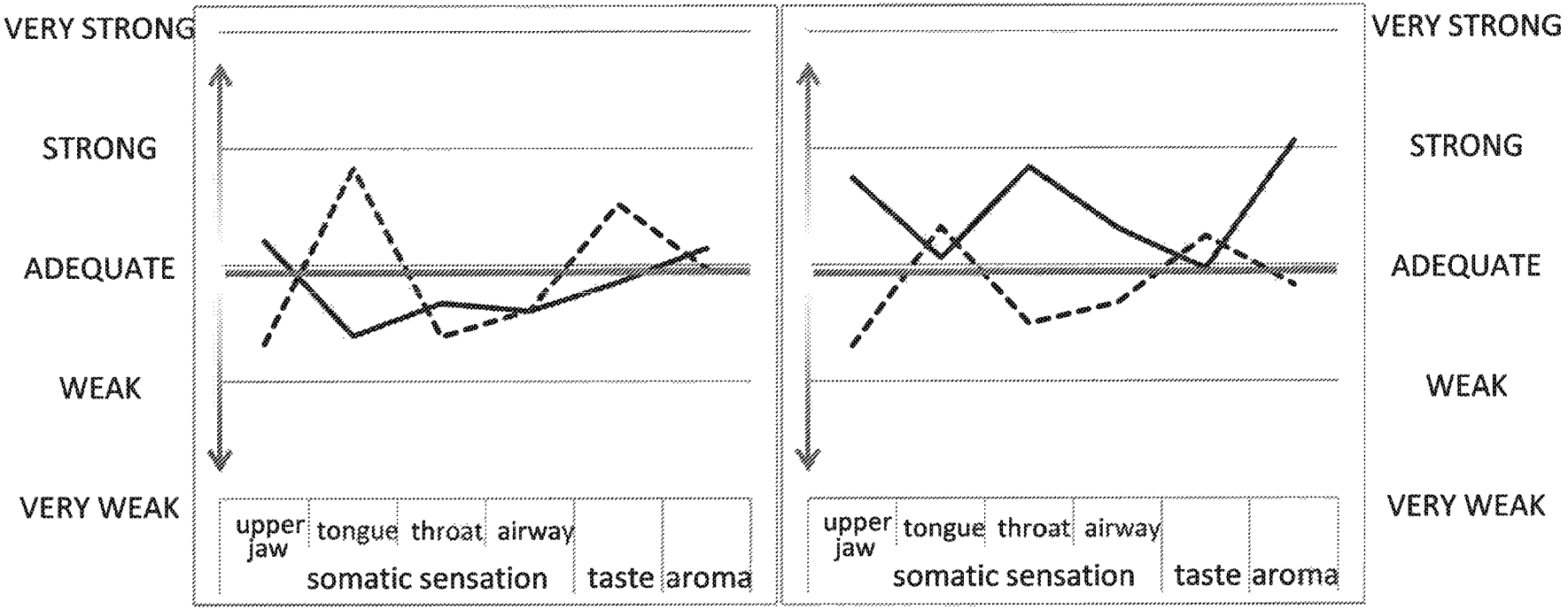
FIG. 14 is a graph illustrating a sensory evaluation result of a cigarette of Example 4.
Figure 15:
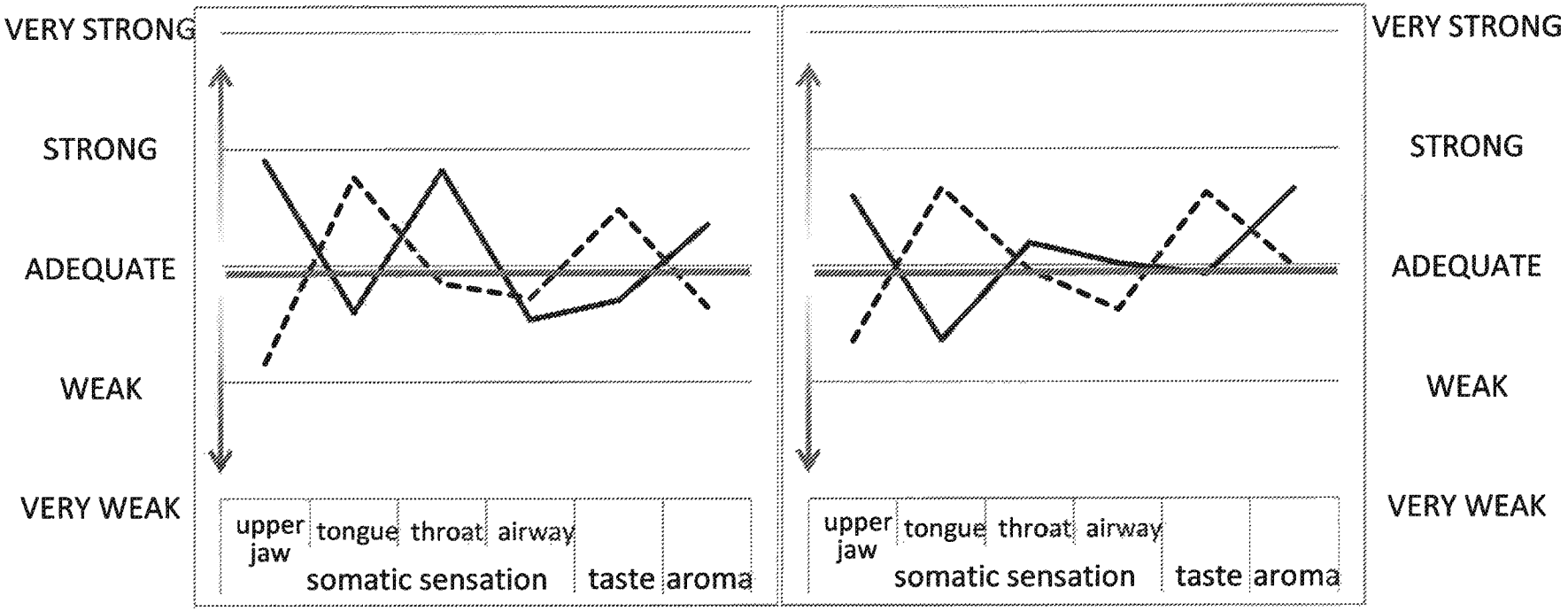
FIG. 15 is a graph illustrating a sensory evaluation result of a cigarette of Example 5.

FIG. 10 is a graph illustrating the sensory evaluation result of the reference cigarette of the comparative example. FIGS. 11 to 15 are graphs illustrating the sensory evaluation result of the cigarettes of Examples 1 to 5. Note that in the graphs of FIGS. 10 to 15, the left graph indicates the sensory evaluation result of when the aroma capsule is crushed while smoking, and the right graph indicates the sensory evaluation result of when the aroma capsule is not crushed while smoking. Also, in FIGS. 10 to 15, the evaluation result corresponding to "smoke upward-flowing posture" is indicated by a solid line, and the evaluation result corresponding to "smoke downward-flowing posture" is indicated by a broken line.

As indicated in FIG. 10, in the case of the reference cigarette, it can be understood that the taste, aroma, and somatic sensation in the upper jaw, tongue, throat, and airway, for example, are hardly affected, even when the way of holding the filter in the mouth while smoking is vertically inverted. On the other hand, as indicated in FIGS. 11 to 15, in the case of the cigarettes of Examples 1 to 5, the sensory evaluation shows that the taste, aroma, and somatic sensation in the upper jaw, tongue, throat, and airway, for example, are affected differently in the aforementioned smoke upward-flowing posture and in the smoke downward-flowing posture. It has been found that the present invention can reversibly change the fragrance inhaling taste by arbitrarily rotating the filter. Also, there is a similar tendency regardless of whether the aroma capsule is crushed.

FIG. 16 is a diagram summarizing results of the sensory evaluations of the cigarettes of Examples 1 to 5. As indicated in FIG. 16, in the case of the cigarettes of Examples 1 to 5, because of differences in the shapes of the hollow passages in the mouthpiece end side-filter material 43, generally corresponding results were obtained as a whole for when smoking with the filter held in the mouth in the smoke upward-flowing posture and when smoking with the filter held in the mouth in the smoke downward-flowing posture, even though there was a slight difference in the pattern and intensity of each evaluation item.

In other words, the obtained result indicates that when smoking the cigarette of the example with the filter held in the mouth in the smoke upward-flowing posture, in terms of somatic sensation, the intensity of stimulation to the upper jaw, throat, and airway can be made relatively strong, and the intensity of stimulation to the tongue can be made relatively weak. The obtained result also indicates that in the smoke upward-flowing posture, the intensity of aroma can be made relatively stronger than taste.

Meanwhile, the obtained result indicates that when smoking the cigarette of the example with the filter held in the mouth in the smoke downward-flowing posture, in terms of somatic sensation, the intensity of stimulation to the upper jaw, throat, and airway can be made relatively weak, and the intensity of stimulation to the tongue can be made relatively strong. The obtained result also indicates that in the smoke downward-flowing posture, the intensity of taste can be made relatively stronger than aroma. These tendencies have been observed in both cases of crushing the aroma capsule while smoking to increase the aroma delivery amount, and not crushing the aroma capsule while smoking.

As has been described, according to the filter of the embodiment and the cigarette including the filter, the fragrance inhaling taste can be reversibly changed at an arbitrary timing, without changing the aroma delivery amount or amounts of tar and nicotine while smoking.

FIG. 17 is a diagram indicating the results of evaluations, based on sensory evaluation tests, made on effects related to the change in the fragrance inhaling taste while smoking, when the shape, position, size, area, and the like of the hollow passage in the cross section of the filter 4 of the cigarette 1 of the example are varied as parameters.

As illustrated in FIG. 6B, in the mouthpiece end side-filter material 43 of the filter 4 of Example 7, the single hollow passage 431B having a circular section is formed as the low air flow-resistance unit, only in the first semicircular area A1 of the cross section formed of the first semicircular area A1 and the second semicircular area A2. As illustrated in FIG. 6C, in the mouthpiece end side-filter material 43 of the filter 4 of Examples 8 to 10, the single hollow passage 431C having a moon-shaped section is formed as the low air flow-resistance unit, only in the first semicircular area A1 of the cross section formed of the first semicircular area A1 and the second semicircular area A2. Examples 7 to 10 differ from one another in parameters such as a sectional area S, width dimension W, borderline maximum distance Dmax, and borderline minimum distance Dmin of the low air flow-resistance unit (hollow passage 431B, hollow passage 431C) arranged in the first semicircular area A1 of the filter 4.

Figure 18:
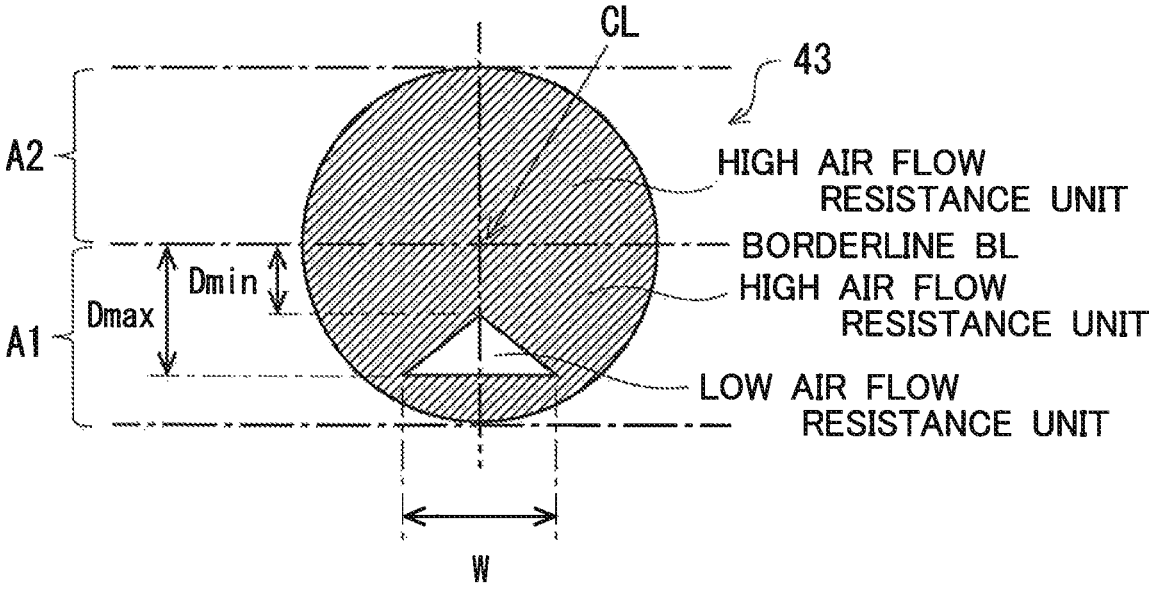
FIG. 18 is a diagram describing parameters of a low air flow-resistance unit of the example.

FIG. 18 is a diagram describing the parameters of the low air flow-resistance unit of the example. In FIG. 18, a triangular low air flow-resistance unit is used as an example to describe its width dimension W, borderline maximum distance Dmax, and borderline minimum distance Dmin. Note that the sectional area S is the area of the low air flow-resistance unit formed in the first semicircular area A1. Here, a direction along a borderline BL between the first semicircular area A1 and the second semicircular area A2 of the mouthpiece end side-filter material 43 is defined as the width direction of the low air flow-resistance unit. As illustrated in FIG. 18, the width dimension W of the low air flow-resistance unit is the dimension of the low air flow-resistance unit, in the direction along the borderline BL between the first semicircular area A1 and the second semicircular area A2.

Figure 19:
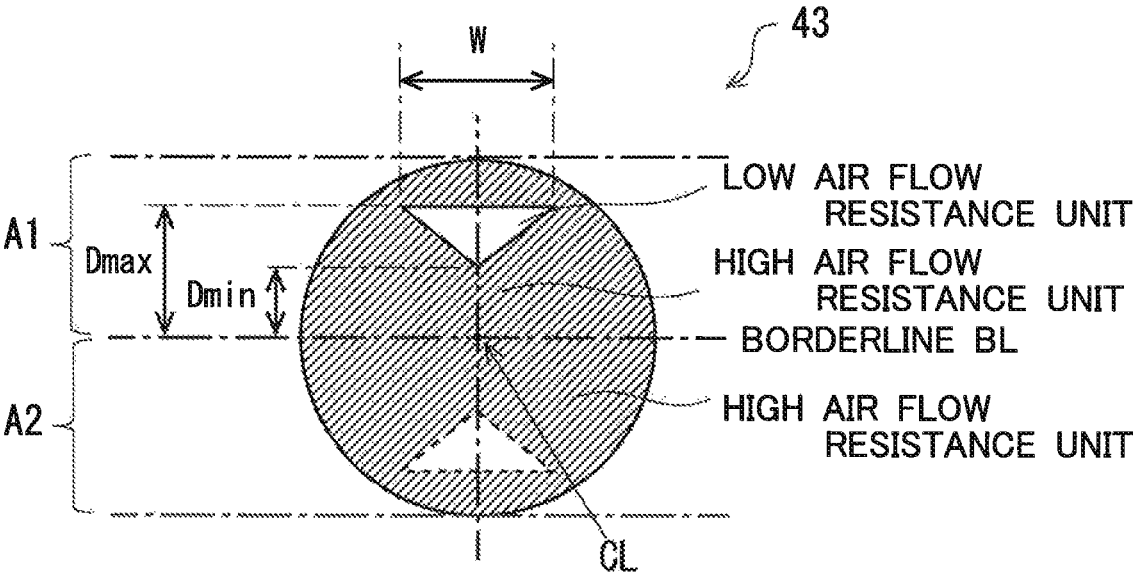
FIG. 19 is a diagram illustrating a state of a posture of a filter after it is rotated for 180 degrees around a central axis from a posture illustrated in FIG. 18.

Next, the borderline maximum distance Dmax refers to the distance, from the borderline BL between the first semicircular area A1 and the second semicircular area A2, of a part of the low air flow-resistance unit farthest away from the borderline BL. Meanwhile, the borderline minimum distance Dmin refers to the distance, from the borderline BL between the first semicircular area A1 and the second semicircular area A2, of a part of the low air flow-resistance unit closest to the borderline BL. FIG. 19 is a diagram illustrating a state after rotating the posture of the filter (cigarette) for 180 degrees around the central axis from the posture illustrated in FIG. 18, to switch from the aforementioned smoke upward-flowing posture to the smoke downward-flowing posture, or from the smoke downward-flowing posture to the smoke upward-flowing posture. The broken line in FIG. 19 indicates a relative position of the low air flow-resistance unit before switching the posture.

In Example 7, the low air flow-resistance unit (hollow passage 431B) has a circular section with a 2 mm diameter, a width dimension W of 2.0 mm, a borderline maximum distance Dmax of 2.8 mm, and a borderline minimum distance Dmin of 0.8 mm. Comparative Example 1 indicated in FIG. 17 is the same as Example 7 except for the position where the low air flow-resistance unit is arranged, and has a borderline maximum distance Dmax of 1.6 mm, and a borderline minimum distance Dmin of −0.5 mm. Here, the negative value (minus) of the borderline minimum distance Dmin indicates that a part of the low air flow-resistance unit extends beyond the borderline BL between the first semicircular area A1 and the second semicircular area A2, and is arranged on the second semicircular area A2 side.

Next, low air flow-resistance units (hollow passages 431C) of Examples 8 to 10 will be described. The low air flow-resistance units (hollow passages 431C) of Examples 8 and 9 are both formed into a small moon shape having a sectional area S of 5.2 $mm^2$ and a width dimension W of 4.0 mm, but have different borderline minimum distances Dmin and different borderline maximum distances Dmax. While Example 8 has a borderline maximum distance Dmax of 2.1 mm and a borderline minimum distance Dmin of 0.1 mm, Example 9 has a borderline maximum distance Dmax of 2.9 mm and a borderline minimum distance Dmin of 0.7 mm. Next, a low air flow-resistance unit (hollow passage 431C) of Example 10 is formed into a large moon shape having a sectional area S of 7.8 $mm^2$ and a width dimension W of 5.3 mm, and has a borderline maximum distance Dmax of 2.8 mm and a borderline minimum distance Dmin of 0.1 mm. Comparative Example 2 indicated in FIG. 17 is the same as Example 10 except for the position where the low air flow-resistance unit is arranged, and has a borderline maximum distance Dmax of 2.1 mm, and a borderline minimum distance Dmin of −0.8 mm. Comparative Example 2 too, has a negative (minus) borderline minimum distance Dmin value, which indicates that a part of the low air flow-resistance unit extends beyond the borderline BL between the first semicircular area A1 and the second semicircular area A2, and is arranged on the second semicircular area A2 side.

A sensory evaluation test was performed for Examples 7 to 10 and Comparative Examples 1 and 2. The sensory evaluation was made by making five evaluators (A to E) smoke each sample, and evaluating the difference in the fragrance inhaling taste, which was obtained when the way of holding the filter 4 in the mouth was vertically inverted. Then, each sample was evaluated in terms of the intensity of change in the fragrance inhaling taste, when smoking by switching to the smoke upward-flowing posture and to the smoke downward-flowing posture, by using four levels of evaluation including "very strong," "strong," "weak," and "very weak."

As indicated in the evaluation result of FIG. 17 described hereinafter, it has been found that an increase in the borderline maximum distance Dmax intensifies the change in the fragrance inhaling taste before and after switching between the smoke upward-flowing posture and the smoke downward-flowing posture and smoking. It has also been found that an increase in the borderline minimum distance Dmin intensifies the change in the fragrance inhaling taste before and after switching between the smoke upward-flowing posture and the smoke downward-flowing posture and smoking.

For example, by setting the borderline maximum distance Dmax and the borderline minimum distance Dmin of the low air flow-resistance unit of Example 7 larger than those of Comparative Example 1, the change in the fragrance inhaling taste when switching between the smoke upward-flowing posture and the smoke downward-flowing posture was intensified.

According to a comparison between Example 8 and Comparative Example 2, by setting the borderline minimum distance Dmin of the low air flow-resistance unit of Example 8 larger than that of Comparative Example 2, the change in the fragrance inhaling taste when switching between the smoke upward-flowing posture and the smoke downward-flowing posture was intensified. Also, according to a comparison between Example 8 and Example 10, by setting the borderline maximum distance Dmax of the low air flow-resistance unit of Example 10 larger than that of Example 8, the change in the fragrance inhaling taste when switching between the smoke upward-flowing posture and the smoke downward-flowing posture was intensified. Also, according to a comparison between Example 9 and Example 10, by setting the borderline minimum distance Dmin of the low air flow-resistance unit of Example 9 larger than that of Example 10, the change in the fragrance inhaling taste when switching between the smoke upward-flowing posture and the smoke downward-flowing posture was intensified.

Here, a larger borderline minimum distance Dmin, and also a larger borderline maximum distance Dmax are likely to increase the amount of change in the part where the mainstream smoke collides inside the mouth cavity, when the posture while smoking is switched between the smoke upward-flowing posture and the smoke downward-flowing posture. As a result, it appears that the degree of change in the fragrance inhaling taste before and after switching between the smoke upward-flowing posture and the smoke downward-flowing posture has intensified. According to the evaluation results indicated in FIG. 17, the borderline minimum distance Dmin is preferably set equal to or larger than 0.1 mm, and more preferably set equal to or larger than 0.7 mm, from the viewpoint of intensifying the change in the fragrance inhaling taste before and after switching between the smoke upward-flowing posture and the smoke downward-flowing posture. The diameter of the filter 4 used in this evaluation test was 7.2 mm, and when the borderline minimum distance Dmin is normalized by use of a value divided by the diameter of the filter 4, the ratio of a radius borderline minimum distance Dmin to the filter diameter is preferably equal to or higher than 1.4%, and more preferably equal to or higher than 9.7%. Also, since a larger borderline minimum distance Dmin of the low air flow-resistance unit can intensify the change in the fragrance inhaling taste before and after switching between the smoke upward-flowing posture and the smoke downward-flowing posture, the maximum value of the ratio of the radius borderline minimum distance Dmin to the filter diameter may be any value, as long as it is lower than 100%. Hence, the ratio of the radius borderline minimum distance Dmin to the filter diameter is preferably equal to or higher than 1% and lower than 100%, and more preferably equal to or higher than 9% and lower than 100%.

Similarly, from the viewpoint of intensifying the change in the fragrance inhaling taste before and after switching between the smoke upward-flowing posture and the smoke downward-flowing posture, the borderline maximum distance Dmax of the low air flow-resistance unit is preferably set equal to or larger than 2.1 mm, and more preferably set equal to or larger than 2.8 mm. When the borderline maximum distance Dmax is normalized by use of a value divided by the diameter of the filter 4, the ratio of the borderline maximum distance Dmax to the filter diameter is preferably equal to or higher than 29.2%, and more preferably equal to or higher than 38.9%. Hence, the ratio of the borderline maximum distance Dmax to the filter diameter is preferably equal to or higher than 29% and lower than 100%, and more preferably equal to or higher than 38% and lower than 100%.

Embodiment 2

Figure 20:
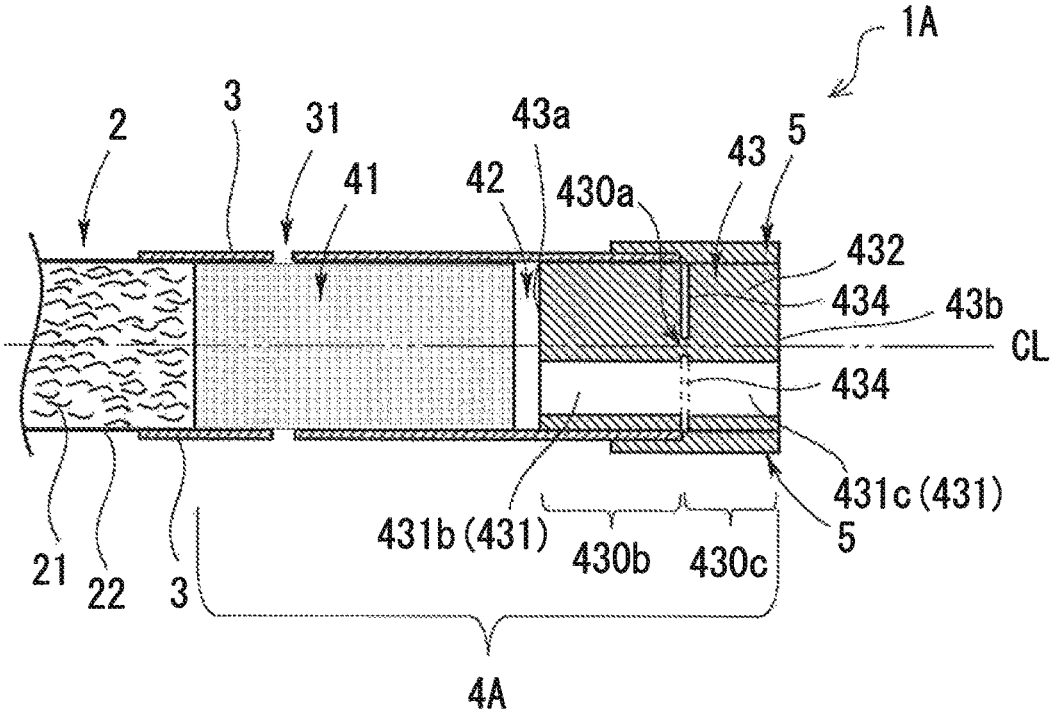
FIG. 20 is a longitudinal section of a cigarette of Embodiment 2.
Figure 21:
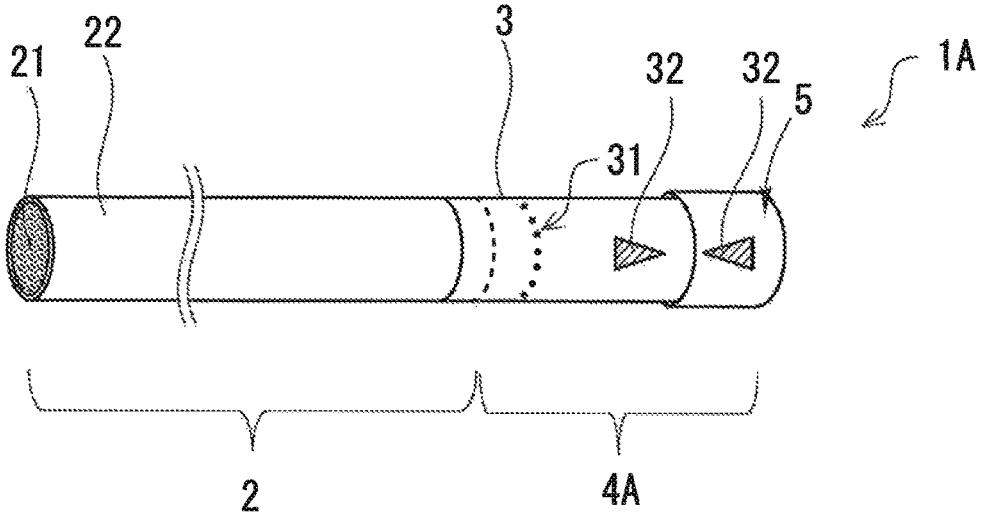
FIG. 21 is an outline drawing of the cigarette of Embodiment 2.

FIG. 20 is a longitudinal section of a cigarette 1A of Embodiment 2. FIG. 21 is an outline drawing of the cigarette 1A of Embodiment 2. Hereinafter, configurations common to the cigarette 1A of Embodiment 2 and the cigarette 1 of Embodiment 1 are assigned the same reference numerals to omit detailed descriptions, and different points will mainly be described.

In a filter 4A of the cigarette 1A of the embodiment, a mouthpiece end side-filter material 43 is configured such that an upstream unit 430*b* and a downstream unit 430*c* respectively positioned on the front end side and the rear end side of an intermediate unit 430*a*, which is positioned between a front end surface and a rear end surface, are freely rotatable relative to each other. Specifically, the intermediate unit 430*a* of the filter 4A has a slit 434, which is cut in while leaving a center part of the cross section of the mouthpiece end side-filter material 43, and the upstream unit 430*b* and downstream unit 430*c* are allowed to rotate relative to each other by being twisted relative to each other on both sides of the slit 434.

The same hollow passages 431 are formed in the upstream unit 430*b* and the downstream unit 430*c* of the mouthpiece end side-filter material 43. Specifically, in the upstream unit 430*b* and the downstream unit 430*c* of the mouthpiece end side-filter material 43, a hollow passage 431 having a relatively lower air flow-resistance than a high air flow-resistance unit 432 is placed only in a first semicircular area A1, of the one first semicircular area A1 and the other second semicircular area A2 that divide the cross section of the upstream unit 430*b* and the downstream unit 430*c* into two parts, while a high air flow-resistance unit 432 is placed in other areas in the cross section. Hereinafter, in the mouthpiece end side-filter material 43, the hollow passage provided in the upstream unit 430*b* is referred to as "upstream hollow passage 431*b*," and the hollow passage provided in the downstream unit 430*c* is referred to as "downstream side hollow passage 431*c*." Also, a paper tube 5 is adhered to the outer periphery of the downstream unit 430*c* of the mouthpiece end side-filter material 43. The front end side of the paper tube 5 overlaps the outside of a tipping paper 3 that wraps the upstream unit 430*b* of the mouthpiece end side-filter material 43, but the paper tube 5 and the tipping paper 3 are not glued together. Since the upstream unit 430*b* and the downstream unit 430*c* of the mouthpiece end side-filter material 43 of the embodiment are rotatable relative to each other, an identification mark 32 is provided on outer peripheral surfaces of both of the upstream unit 430*b* and the downstream unit 430*c*.

Figure 22:
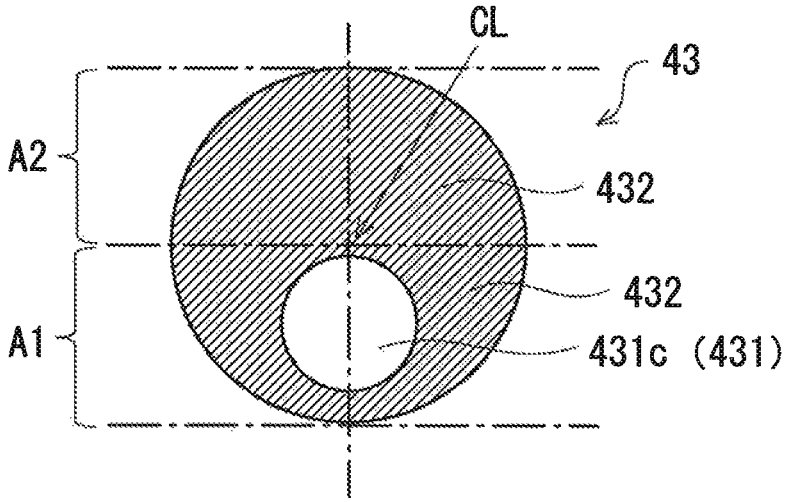
FIG. 22 is a cross section of a downstream unit of a mouthpiece end side-filter material of Embodiment 2.

FIG. 22 is a cross section of the downstream unit 430*c* of the mouthpiece end side-filter material 43 of the embodiment. In the embodiment, the hollow passages 431*b*, 431*c* having circular sections are formed only in the first semicircular area A1 of the upstream unit 430*b* and downstream unit 430*c* of the mouthpiece end side-filter material 43. Note, however, that the hollow passage may be formed in various shapes as in the case of Embodiment 1.

According to the cigarette 1A of the embodiment, it is possible to vary an area (hereinafter referred to as hollow passage facing area S) in which the upstream side hollow passage 431*b* of the upstream unit 430*b* and the downstream side hollow passage 431*c* of the downstream unit 430*c* overlap each other at the intermediate unit 430*a*, by rotating the downstream unit 430*c* of the mouthpiece end side-filter material 43 relative to the upstream unit 430*b* thereof by twisting, for example. Then the rate of linear velocity of mainstream smoke flowing through the downstream side hollow passage 431*c* of the mouthpiece end side-filter material 43 is controlled by the hollow passage facing area S. Hence, when smoking the cigarette 1A, the linear velocity of mainstream smoke flowing into the mouth cavity of the smoker from the mouthpiece end of the filter 4A can be varied by rotating the upstream unit 430*b* and downstream unit 430*c* of the mouthpiece end side-filter material 43 relative to each other. That is, the velocity of mainstream smoke flowing into the mouth cavity when smoking can be increased by reducing the hollow passage facing area S, and conversely, the velocity of mainstream smoke flowing into the mouth cavity when smoking can be reduced by increasing the hollow passage facing area S.

According to the filter 4A and the cigarette 1A of the embodiment, the fragrance inhaling taste can be changed by changing the posture of the filter 4*a* held in the mouth when smoking, to thereby change the part where the mainstream smoke hits in the mouth cavity, as in Embodiment 1. Moreover, by changing the relative angle between the upstream unit 430*b* and downstream unit 430*c* of the mouthpiece end side-filter material 43 as mentioned above, the linear velocity of the mainstream smoke flowing into the mouth cavity of the smoker can be changed, so that the intensity of stimulation sensed when smoking can be changed arbitrarily.

Although preferable embodiments of the present invention have been described, various changes, improvements, combinations and the like can be made for the filter for cigarette product of the embodiment. Additionally, although the above embodiments have been described by using a case of applying the filter for cigarette product of the invention to a cigarette as an example, the filter for cigarette product of the invention is also applicable to cigarette products other than a cigarette, such as a cigar, a cigarillo, a SNUS, a snuff, a chewing tobacco, and an electronic cigarette.

Figure 23:
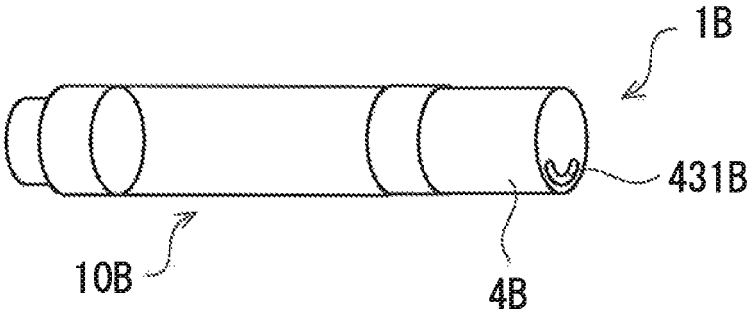
FIG. 23 is a diagram illustrating a non-heating suction tool to which the filter for cigarette product of an embodiment is applied (1).
Figure 24:
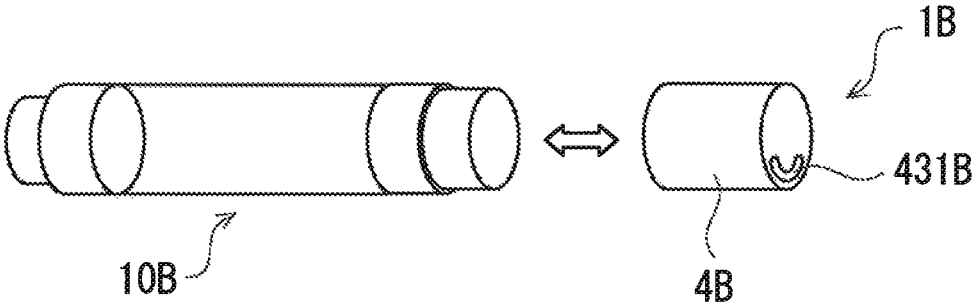
FIG. 24 is a diagram illustrating a non-heating suction tool to which the filter for cigarette product of the embodiment is applied (2).
Figure 25:
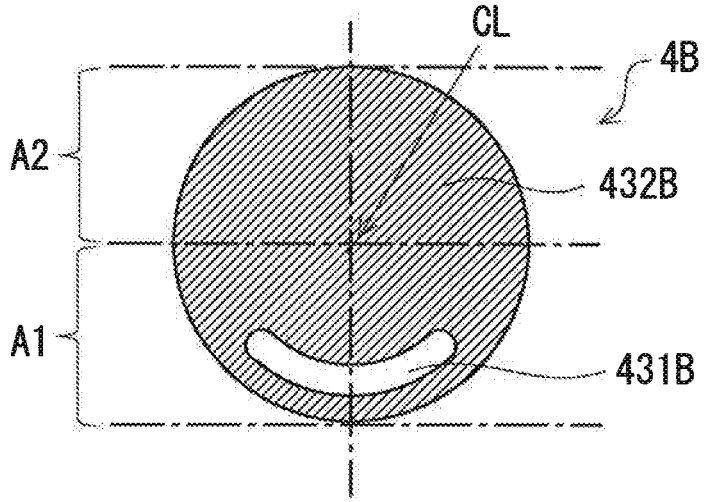
FIG. 25 is a diagram illustrating a cross section of a mouthpiece of a non-heating suction tool.
Figure 26:
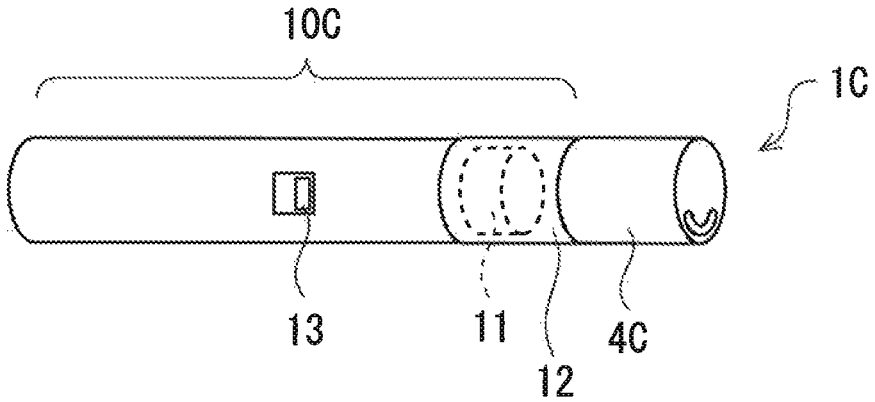
FIG. 26 is a diagram illustrating a heating suction tool to which the filter for cigarette product of the embodiment is applied.

A non-heating suction tool illustrated in FIGS. 23 to 25, and a case of applying the mouthpiece end shape of the present invention to the mouthpiece end side of a mouthpiece of a heat suction tool illustrated in FIG. 26, are examples of applying the filter for cigarette product of the present invention to a cigarette product other than a cigarette.

A non-heating suction tool 1B illustrated in FIGS. 23 to 25 has a cartridge 10B accommodating a snuff material, and a mouthpiece 4B attached to the cartridge 10B. The cartridge 10 is freely detachable from the mouthpiece 4B. The cartridge 10B and mouthpiece 4B are formed by resin molding, for example. The non-heating suction tool 1B is a so-called smokeless cigarette. The snuff material is formed by mixing together shredded tobacco leaves and aroma, for example, to add a tobacco flavor. Note that an air-permeable lid member is fitted into both ends of the cartridge 10B in the axial direction, and the user of the non-heating suction tool 1B can suck in air by holding the mouthpiece 4B in his/her mouth. When the user sucks in from the mouthpiece 4B, air flowed in from the rear end of the cartridge 10B comes into contact with the snuff material, and the user can taste the flavor of the snuff material by sucking in the air containing the snuff flavor.

FIG. 25 is a cross section of the mouthpiece 4B. The mouthpiece 4B has a hollow passage 431B formed in a part of its cross section, and air containing the flavor of the snuff material is sucked into the mouth cavity of the user through the hollow passage 431B. As in the aforementioned embodiments, the hollow passage 431B is arranged (exists) only in one first semicircular area A1, of two parts into which the cross section of the mouthpiece 4B is divided, and is not arranged (not exist) in the other second semicircular area A2. Note that of the cross section of the mouthpiece 4B, a non-hollow unit 432B where the hollow passage 431B is not formed obstructs the flow of air containing the flavor of the snuff material. That is, the hollow passage 431B in the cross section of the mouthpiece 4B has a significantly lower air flow-resistance than the non-hollow unit 432B, so that the air passes through only the hollow passage 431B.

According to the mouthpiece 4B of the non-heating suction tool 1B configured in this manner, the flavor of the snuff material can be changed by changing the posture of the mouthpiece 4B when sucking in, and thereby changing the part where the sucked in air containing the flavor of the snuff material hits in the mouth cavity.

A heating suction tool 1C illustrated in FIG. 26 is a suction tool that generates spray-like vapor containing tobacco constituents by heating a pod filled with a tobacco material, and allows the user to taste the flavor of the tobacco material by sucking in the vapor, for example. The heating suction tool 1C has a main body unit 10C and a mouthpiece 4C. The mouthpiece 4C is freely detachable from a tip end part of the main body unit 10C, and has substantially the same configuration as the mouthpiece 4B described in FIG. 25. Additionally, a heating unit 12 that accommodates a pod 11 and also heats the accommodated pod 11 is provided, on the tip end side of the main body unit 10C. A switch 13 that can be operated by the user to switch on and off is provided on the main body unit 10C. When the user turns the switch 13 on, a heater (not shown) provided in the heating unit 12 is actuated, and heats the pod 11. This generates a spray-like vapor containing tobacco constituents in the heating unit 12, and the user can suck in the vapor through the mouthpiece 4C.

Since this heating suction tool 1C, too, includes the same mouthpiece 4C as the mouthpiece 4B illustrated in FIG. 25, the user can change the flavor of the vapor by changing the posture of the mouthpiece 4C when sucking in, to thereby change the part where the sucked in vapor hits in the mouth cavity. Note that the shape of the mouth piece 4B (mouth piece 4C) is not limited to the circular shape, and may be a polygon. For example, from the viewpoint of increasing retentivity, it is preferable that the mouthpiece 4B (mouthpiece 4C) be formed into a hexagon. Also, creating the mouthpiece 4B (mouthpiece 4C) from resin such as plastic is advantageous in that an arbitrary shape can be formed easily.

REFERENCE SIGNS LIST

1 . . . cigarette
2 . . . cigarette rod
3 . . . tipping paper
4 . . . filter
31 . . . air hole
32 . . . identification mark
41 . . . front stage-filter material
42 . . . cavity unit
43 . . . mouthpiece end side-filter material
A1 . . . first semicircular area
A2 . . . second semicircular area
431 . . . hollow passage
432 . . . high air flow-resistance unit

The invention claimed is:

1. A filter for cigarette product comprising:

a mouthpiece end side-filter material that is arranged on the mouthpiece end side; and a front stage-filter material that is arranged at the front stage of the mouthpiece end side-filter material and filters mainstream smoke, wherein:

the mouthpiece end side-filter material has a low air flow-resistance unit that is arranged in a part of a cross section from a front end surface to a rear end surface and having a relatively low air flow-resistance, and a high air flow-resistance unit that is arranged in the remainder of the cross section from the front end surface to the rear end surface and having a higher air flow-resistance than the low air flow-resistance unit;

at least on the rear end surface of the mouthpiece end side-filter material, the low air flow-resistance unit is arranged only in one semicircular area, of two parts into which the cross section of the mouthpiece end side-filter material is divided by a borderline passing through a central axis of the cross section; and wherein in the mouthpiece end side-filter material, an upstream unit and a downstream unit respectively positioned on the front end side and the rear end side of an intermediate unit, which is positioned between the front end surface and the rear end surface, are freely rotatable relative to each other.

2. The filter for cigarette product according to claim 1, wherein a hollow cavity unit is provided between the front stage-filter material and the mouthpiece end side-filter material.

3. The filter for cigarette product according to claim 1, wherein a slit that is formed in the intermediate unit of the mouthpiece end side-filter material and cut in while leaving a center part of the cross section of the mouthpiece end side-filter material allows the upstream unit and the downstream unit to freely rotate relative to each other.

4. The filter for cigarette product according to claim 1, wherein the high air flow-resistance unit is formed of a single material.

5. The filter for cigarette product according to claim 1, wherein the low air flow-resistance unit is a hollow unit formed from the front end surface to the rear end surface of the mouthpiece end side-filter material.

6. The filter for cigarette product according to claim 1, wherein identification unit that allows a smoker to identify a position of the low air flow-resistance unit, which is arranged in a decentered manner in the cross section of the mouthpiece end side-filter material, is provided on an outer peripheral surface of the filter for cigarette product.

7. The filter for cigarette product according to claim 1, wherein the mouthpiece end side-filter is a polygon.

8. A cigarette product comprising the filter for cigarette product according to claim 1.

* * * * *